US007711554B2

(12) United States Patent
Mori et al.

(10) Patent No.: US 7,711,554 B2
(45) Date of Patent: May 4, 2010

(54) SOUND PACKET TRANSMITTING METHOD, SOUND PACKET TRANSMITTING APPARATUS, SOUND PACKET TRANSMITTING PROGRAM, AND RECORDING MEDIUM IN WHICH THAT PROGRAM HAS BEEN RECORDED

(75) Inventors: Takeshi Mori, Higashiyamoto (JP); Hitoshi Ohmuro, Kodaira (JP); Yusuke Hiwasaki, Kodaira (JP); Akitoshi Kataoka, Nerima-ku (JP)

(73) Assignee: Nippon Telegraph and Telephone Corporation, Tokyo (JP)

( * ) Notice: Subject to any disclaimer, the term of this patent is extended or adjusted under 35 U.S.C. 154(b) by 1016 days.

(21) Appl. No.: 10/580,195

(22) PCT Filed: May 10, 2005

(86) PCT No.: PCT/JP2005/008519

§ 371 (c)(1),
(2), (4) Date: May 23, 2006

(87) PCT Pub. No.: WO2005/109402

PCT Pub. Date: Nov. 17, 2005

(65) Prior Publication Data

US 2007/0150262 A1 Jun. 28, 2007

(30) Foreign Application Priority Data

May 11, 2004 (JP) ..... 2004-141375

(51) Int. Cl.
*G10L 19/14* (2006.01)
*G10L 21/02* (2006.01)
*G10L 21/04* (2006.01)

(52) U.S. Cl. ..... 704/211; 704/226; 704/503

(58) Field of Classification Search ..... None
See application file for complete search history.

(56) References Cited

U.S. PATENT DOCUMENTS 6,167,060 A * 12/2000 Vargo et al. ..... 370/468

(Continued)

FOREIGN PATENT DOCUMENTS

JP 10-97295 4/1998

(Continued)

OTHER PUBLICATIONS

"Internet Protocol", RFC791, pp. 1-38, 1981.

(Continued)

*Primary Examiner*—David R Hudspeth
*Assistant Examiner*—Brian L Albertalli
(74) *Attorney, Agent, or Firm*—Oblon, Spivak, McClelland, Maier & Neustadt, L.L.P.

(57) ABSTRACT

Input speech is coded in an encoder (11), the coded speech is decoded in a decoder (12), compensatory speech which compensates the speech of the current frame is generated in a compensatory speech generating part (20) by using past decoded speech, the quality of the compensatory speech is evaluated by using the input speech and the compensatory speech and a duplication level is generated the value of which increases incrementally with decreasing speech quality evaluation value in a speech quality evaluating part (40), and as many identical packets as the number specified by the duplication level is generated for the coded speech in a packet generating part (15), and the packets are transmitted, thereby reducing the possibility that packet loss will occur at the receiving end.

9 Claims, 25 Drawing Sheets

U.S. PATENT DOCUMENTS

| | | | | |
|---|---|---|---|---|
| 7,133,364 | B2 * | 11/2006 | Park | 370/231 |
| 7,251,241 | B1 * | 7/2007 | Jagadeesan et al. | 370/352 |
| 2001/0012993 | A1 | 8/2001 | Attimont et al. | |
| 2003/0056168 | A1 | 3/2003 | Krishnamachari | |
| 2006/0167693 | A1 * | 7/2006 | Kapilow | 704/258 |
| 2008/0151921 | A1 * | 6/2008 | Gentle et al. | 370/412 |

FOREIGN PATENT DOCUMENTS

| | | |
|---|---|---|
| JP | 11-177623 | 7/1999 |
| JP | 2000-115248 | 4/2000 |
| JP | 2002-162998 | 6/2002 |
| JP | 2002-268696 | 9/2002 |
| JP | 2002-534922 | 10/2002 |
| JP | 2003-249957 | 9/2003 |
| JP | 2003-316670 | 11/2003 |
| JP | 2004-80625 | 3/2004 |
| JP | 2004-120619 | 4/2004 |

OTHER PUBLICATIONS

"Transmission Control Protocol", RFC793, pp. 1-70, 1981.
"User Datagram Protocol", RFC768, pp. 1-3, 1980.
ITU-T Recommendation G.711 Appendix I, "A high quality low-complexity algorithm for packet loss concealment with G.711" pp. 1-18, 1999.
Nurminen, Jani et al., "Objective Evaluation of Methods for Quantization of Variable-Dimension Spectral Vectors in WI Speech Coding", in Proc. Eurospeech 2001, pp. 1969-1972, 2001.
Benjamin W. Wah, et al., "A Survey of Error-Concealment Schemes for Real-Time Audio and Video Transmissions over the Internet", Proceedings International Symposium on Multimedia Software Engineering, XP 000992346, Dec. 11, 2000, pp. 17-24.
M.M. Lara-Barron, et al., "Packet-based embedded encoding for transmission of low-bit-rate-encoded speech in packet networks", Iee Proceedings-I, XP 000316075, vol. 139, No. 5, Oct. 1992, pp. 482-487.
Toru Morinaga, et al., "The Forward-Backward Recovery Sub-Codec (FB-RSC) Method: A Robust Form of Packet-Loss Concealment For Use In Broadband IP Networks", IEEE Workshop Proceedings, XP 010647213, Oct. 6, 2002, pp. 62-64.
Juan Carlos De Martin, "Source-Driven Packet Marking For Speech Transmission Over Differentiated-Services Networks", 2001 IEEE International Conference On Acoustics, Speech and Signal Processing Proceedings, XP 010803765, vol. 1, May 7, 2001, pp. 753-756.
Mei Yong, "Study of Voice Packet Reconstruction Methods Applied to CELP Speech Coding", Digital Signal Processing 2 Estimation, XP 010058844, vol. 5, Mar. 23, 1992, pp. 125-128.
Thomas J. Kostas, et al., "Real-Time Voice Over Packet-Switched Networks", IEEE Network, XP 000739804, vol. 12, No. 1, Jan./Feb. 1998, pp. 18-27.

* cited by examiner

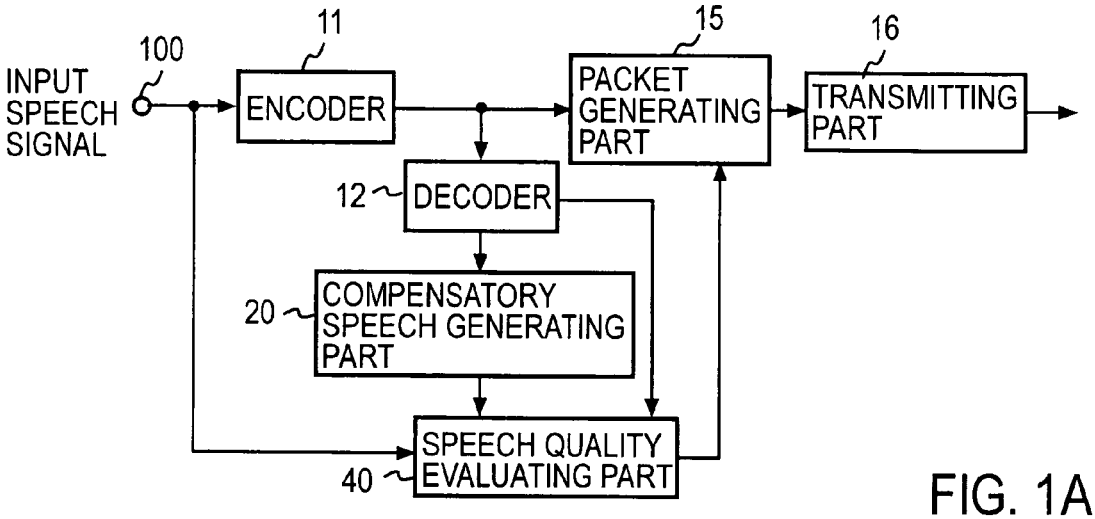
FIG. 1A
| DEST ADD | ORG ADD | FR# | DATA |
|---|---|---|---|
FIG. 1B
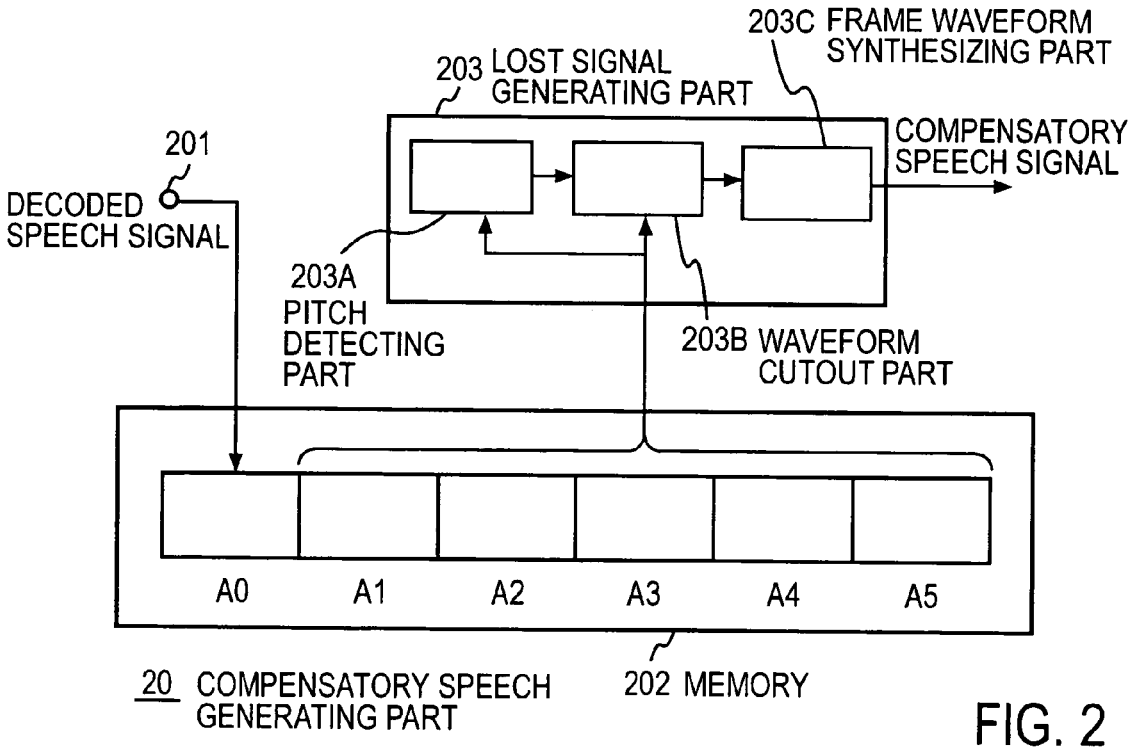
FIG. 2

| CRITERION | DETERMINED VALUE |
|---|---|
| Fd=Fw1−Fw2 (dB) | Ld |
| Fd < 2dB | 1 |
| 2dB ≦ Fd < 10dB | 2 |
| 10dB ≦ Fd < 15dB | 3 |
| 15dB ≦ Fd | 4 |

| CRITERION | | DETERMINED VALUE |
|---|---|---|
| Fd1 | Fd=Fw1−Fw2 | Ld |
| LESS THAN 1.5 | Fd < 2dB | 1 |
| | 2dB ≦ Fd < 10dB | 2 |
| | 10dB ≦ Fd < 15dB | 3 |
| | 15dB ≦ Fd | 4 |
| 1.5 OR GREATER | Fd < 5dB | 1 |
| | 5dB ≦ Fd | 2 |

| CRITERION | | | DETERMINED VALUE |
|---|---|---|---|
| Fd1 | Fd=Fw1−Fw2 | Fd2 | Ld |
| LESS THAN 1.5 | Fd < 10dB | LESS THAN 1.0 | 1 |
| | | 1.0 OR GREATER | 2 |
| | 10dB ≦ Fd < 15dB | — | 3 |
| | 15dB ≦ Fd | — | 4 |
| 1.5 OR GREATER | Fd < 5dB | — | 1 |
| | 5dB ≦ Fd | — | 2 |

| CRITERION | DETERMINED VALUE |
|---|---|
| Fw' (dB) | Ld |
| Fw' < 2dB | 1 |
| 2dB ≦ Fw' < 10dB | 2 |
| 10dB ≦ Fw' | 3 |

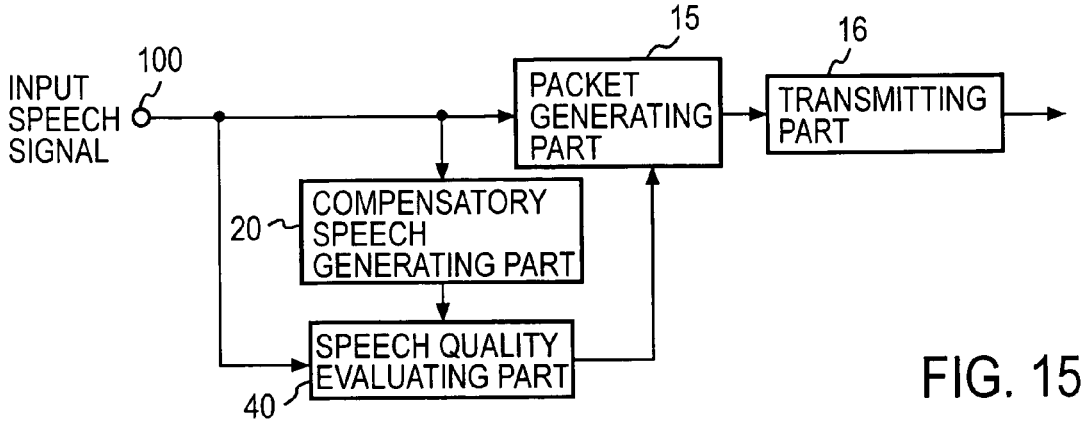
FIG. 15
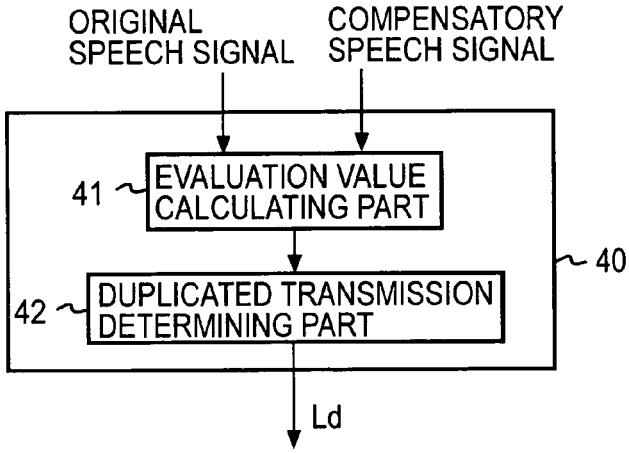
FIG. 16
| CRITERION | DETERMINED VALUE |
|---|---|
| Fw (dB) | Ld |
| Fw < 2dB | 3 |
| 2dB ≦ Fw < 10dB | 2 |
| 10dB ≦ Fw | 1 |
FIG. 17

| CRITERION | DETERMINED VALUE | |
|---|---|---|
| Fd1=Fw1-Fw2_1(dB) | Ld | SPEECH QUALITY DEGRADATION LEVEL QL_1 |
| Fd1 < 2dB | 1 | 1 |
| 2dB ≦ Fd1 < 10dB | 2 | 2 |
| 10dB ≦ Fd1 < 15dB | 3 | 3 |
| 15dB ≦ Fd1 | 4 | 4 |

| CRITERION | DETERMINED VALUE |
|---|---|
| Fd2=Fw1-Fw2_2(dB) | SPEECH QUALITY DEGRADATION LEVEL QL_2 |
| Fd1 < 2dB | 1 |
| 2dB ≦ Fd1 < 10dB | 2 |
| 10dB ≦ Fd1 < 15dB | 3 |
| 15dB ≦ Fd1 | 4 |

SOUND PACKET TRANSMITTING METHOD, SOUND PACKET TRANSMITTING APPARATUS, SOUND PACKET TRANSMITTING PROGRAM, AND RECORDING MEDIUM IN WHICH THAT PROGRAM HAS BEEN RECORDED

TECHNICAL FIELD

The present invention relates to a speech packet transmitting method, apparatus, and program for performing the method in an IP (Internet Protocol) network, and a recording medium on which the program is recorded.

BACKGROUND ART

Today, various types of communications such as electronic mail and WWW (World Wide Web) communications are performed on the Internet by using IP (Internet Protocol) (see Non-patent literature 1) packets.

The Internet, widely used today, is a best-effort network, in which delivery of packets are not guaranteed. Therefore, communication that performs retransmission control using the TCP (Transmission Control Protocol) (see Non-Patent literature 2) is often used to ensure more reliable packet transmission. However, if retransmission control is performed to resend a lost packet on occurrence of packet loss in such communications as communication using VoIP (Voice over Internet Protocol) in which real-time nature is essential, the arrival of packets will be significantly delayed and therefore the number of packets that are stored in a receiving buffer will have to be set to a large value, which spoils the real-time nature. Therefore, such communications as VoIP communications are typically performed by using the UDP (User Datagram Protocol) (see Non-patent literature 3), which does not use retransmission control. However, this has posed the problem that packet loss occurs during network congestion and consequently the speech quality is degraded.

One conventional approach to preventing speech quality degradation without resending packets is to send the duplications of the same packet in accordance with the packet loss rate during the transmission to increase the probability of arrival of packets, thereby preventing speech interruptions (see Patent literature 1). However, packet loss occurs most frequently during network congestion and if excessive duplicated packets are sent in such a state, there arises a problem that the increase in the amount of information sent and the number of sent packets aggravates network congestion and consequently further increases the number of packet losses. Another problem is that, because duplicated packets are being sent constantly while the packet loss rate is high, the network transmission interface is overloaded, resulting in packet transmission delay.

An approach to preventing speech quality degradation due to packet loss without increasing delay is a speech data compensation approach. For example, the method in G.711 Appendix I (see Non-patent literature 4) repeats data in the past pitch period to fill a lost segment. However, this method has a problem that, if speech data in a region such as a speech rising period in which a signal changes drastically is lost, abnormal noise occurs, because the speech data synthesized from the past data has a power and pitch different from those in original speech.

Another approach has been proposed in which the sending end assumes that packet loss will occur at the receiving end and the sending end synthesizes a speech waveform by repeating a speech waveform of the pitch length in the current frame and, if the quality of the synthesized speech waveform with respect to that of the original speech waveform of the next frame is lower than a threshold, then a compressed speech code of the next frame is sent as a sub-frame code along with the speech code of the current frame by using packets (Patent literature 2). With this method, on the occurrence of packet loss of the current frame at the receiving end, if a sub-frame code is not contained in any of the packets of the preceding and succeeding frames, the current frame is synthesized from the waveform of one pitch length in the preceding frame, or if a sub-frame code is contained, the code is decoded and used. In either case, a speech waveform with a lower quality than that of the original speech signal will be generated. This method has the following problem: the method adds the sub-codec information to the preceding and succeeding packets in addition to the current frame on condition that the quality of the compensatory waveform is lower than a specified value, therefore if three or more consecutive packets are lost, both of the coded information of the current frame and the sub-codec coded information which is sent using the preceding and succeeding packets cannot be available and thus the quality of the decoded speech is degraded.

Patent literature 1: Japanese Patent Application Laid-Open No. 11-177623

Patent literature 2: Japanese Patent Application Laid-Open No. 2003-249957

Non-patent literature 1: "Internet Protocol", RFC791, 1981

Non-patent literature 2: "Transmission Control Protocol", RFC793, 1981

Non-patent literature 3: "User Datagram Protocol", RFC768, 1980

Non-patent literature 4: ITU-T Recommendation G.711 Appendix I, "A high quality low-complexity algorithm for packet loss concealment with G.711", pp. 1-18, 1999

Non-patent literature 5: J. Nurminen, A. Heikkinen & J. Saarinen, "Objective evaluation of methods for quantization of variable-dimension spectral vectors in WI speech coding", in Proc. Eurospeech 2001, Aalborg, Denmark, September 2001, pp. 1969-1972

DISCLOSURE OF THE INVENTION

Issues to be Solved by the Invention

The present invention has been made in light of the problems stated above and an object of the present invention is to provide a speech packet transmitting method, an apparatus therefor, and a recording medium on which a program therefor is recorded, capable of minimizing loss of frame data that is important for speech reproduction, and alleviating degradation of quality of reproduced speech in two-way speech communication in which real-time nature is essential while avoiding delay and preventing a network from being overloaded.

Means to Solve Issues

According to the present invention, a compensatory speech signal relating to the speech signal of the current frame is generated from a speech signal excluding the current-frame speech signal portion, a speech quality evaluation value of the compensatory speech signal is calculated, a duplication level that takes a value increasing gradually as the speech quality of the compensatory signal degrades is obtained on the basis of the speech quality evaluation value, as many identical speech packets as the number specified by the duplication level are generated, and the identical speech packets are transmitted to a network.

EFFECTS OF THE INVENTION

According to a configuration of the present invention, only a frame speech signal for which an adequate speech reproduction quality cannot be ensured by a compensatory speech signal is redundantly transmitted. Accordingly, at whichever timing in a speech signal packet loss occurs, a reproduction speech signal with good speech quality can be obtained at the receiving end without increasing packet delay and without overloading the network.

BRIEF DESCRIPTION OF THE DRAWINGS

FIG. 1A is a block diagram showing an exemplary functional configuration of a speech packet transmitting apparatus according to a first embodiment of the present invention;

FIG. 1B is a block diagram showing an exemplary structure of a packet;

FIG. 2 is a block diagram showing a specific exemplary functional configuration of a compensatory speech generating part 20 shown in FIG. 1A;

FIG. 15 is a block diagram showing an exemplary functional configuration of a speech packet transmitting apparatus according to a second embodiment of the present invention;

FIG. 16 is a block diagram showing a specific exemplary functional configuration of a speech quality evaluating part 40 shown in FIG. 15;

FIG. 17 shows yet another exemplary table defining the relation between evaluation values and duplication levels;

BEST MODES FOR CARRYING OUT THE INVENTION

First Embodiment

Figure 3A:
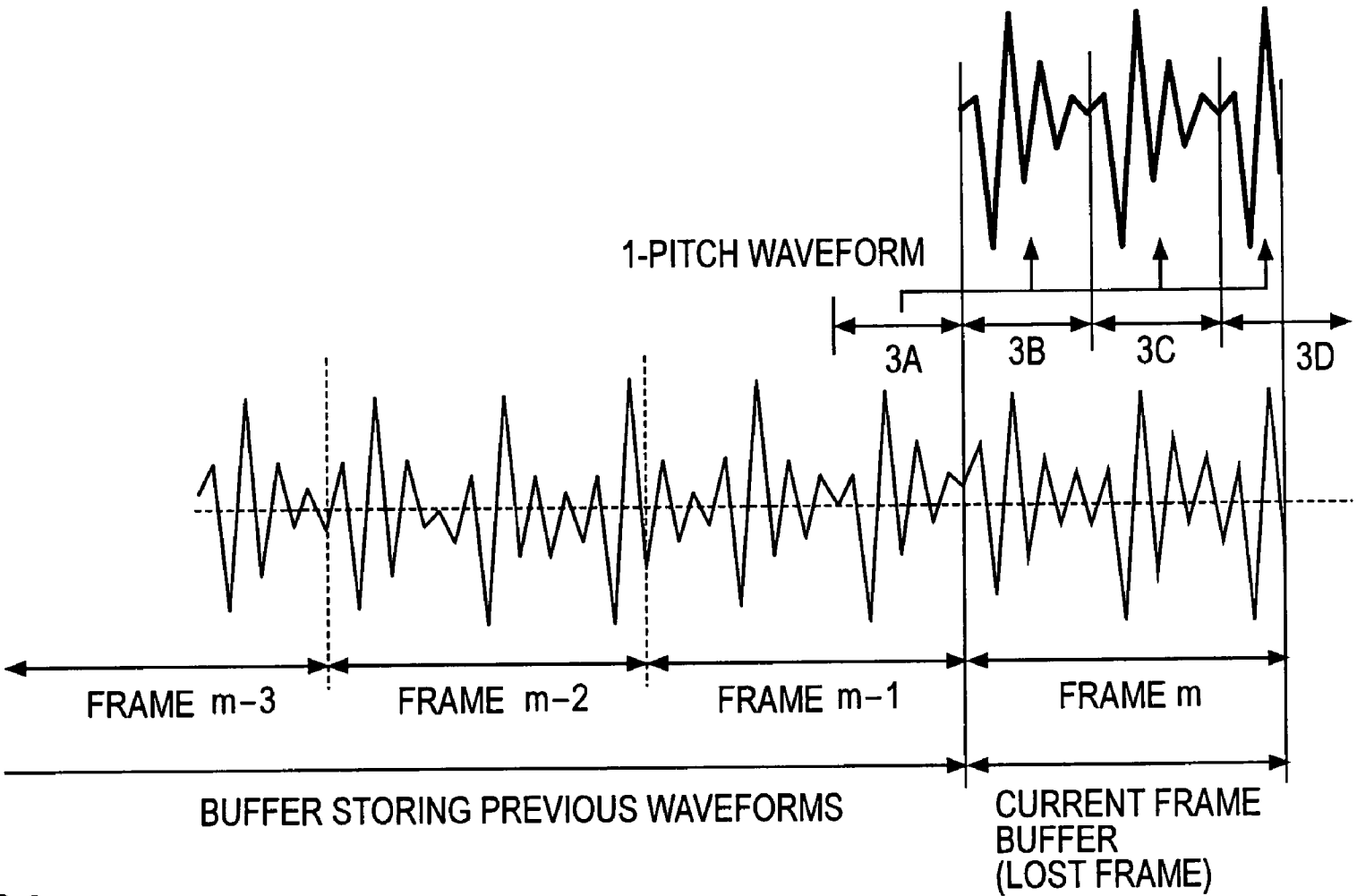
FIG. 3A is a diagram for describing a method for synthesizing a waveform.

FIG. 1 shows an exemplary functional configuration of a speech packet transmitting apparatus according to a first embodiment of the present invention. In the present invention, packets are sent and received by using the UDP/IP protocol. According to the UDP/IP protocol, each packet contains a destination address DEST ADD, a source address ORG ADD, and data in RTP format as shown in FIG. 1B. The frame number FR# of the speech signal and speech data DATA is included as the RTP-format data. The speech data may be an encoded speech signal produced by encoding an input PCM speech signal or may be an uncoded input PCM speech signal. In this embodiment, speech data contained in a packet is a coded speech signal. While it is assumed in the following description that one frame of speech data is contained in one packet and transmitted, multiple frames of speech data may be contained in one packet.

An input PCM speech signal is inputted through the input terminal 100 into an encoder 11, where the signal is encoded. The encoding algorithm used in the encoder 11 may be any encoding algorithm that can handle the speech band f input signals. An encoding algorithm for the speech band signals (up to 4 kHz), such as ITU-T G.711, or an encoding algorithm for broadband signals over 4 kHz, such as ITU-T G.722 may be used. While it depends on encoding algorithms, encoding of a speech signal in one frame typically generates codes of multiple parameters that are dealt with by the encoding algorithm. These parameters will be collectively and simply called a coded speech signal.

The code sequence of the coded speech signal outputted from the encoder 11 is fed into a packet generating part 15 and at the same time to a decoder 12, where it is decoded into a PCM speech signal by using a decoding algorithm corresponding to the encoding algorithm used in the encoder 11. The speech signal decoded in the decoder 12 is provided to a compensatory speech generating part 20, where a compensatory speech signal is generated through a process similar to a compensation process that is performed when packet loss occurred at a destination receiving apparatus. The compensatory speech signal may be generated by using extrapolation from the waveform of the frame preceding the current frame or may be generated by using interpolation from the waveforms of the frames preceding and succeeding the current frame.

FIG. 2 shows a specific exemplary functional configuration of the compensatory speech generating part 20. Here, extrapolation is used to generate a compensatory speech signal. The decoded speech signal from the input terminal 201 is stored in an area A0 of a memory 202. Each of the areas A0, . . . , A5 of the memory 202 has a size accommodating a PCM speech signal with the analysis frame length used in the encoding. For example, if a decoded speech signal sampled at 8 kHz is encoded with an analysis frame length of 10 ms, 80 decoded speech signal samples will be stored in one area. Each time one analysis frame of decoded speech signal is inputted into the memory 202, the decoded speech signal of the past frame that is already stored in areas A0-A4 is shifted to areas A1-A5 and the decoded speech signal of the current frame is written into area A0.

The speech signal stored in the memory 202 is used by a lost signal generating part 203 to generate a compensatory speech signal for the current frame. Inputted in the lost signal generating part 203 is a speech signal stored in areas A1-A5, excluding area A0, in the memory 202. While a case is described here in which 5 consecutive frames of speech signal in areas A1-A5 in the memory 202 are sent to the lost signal generating part 203, enough memory must be provided in the memory 202 that can store past PCM speech signal samples required by an algorithm for generating a compensatory speech signal for one frame (packet). The lost signal generating part 203 in this example generates and outputs a speech signal for the current frame from a decoded speech signal (in five frames in this embodiment), excluding the input speech signal (the speech signal of the current frame) by using compensation method.

The lost signal generating part 203 includes a pitch detecting part 203A, a waveform cutout part 203B, and frame waveform synthesizing part 203C. The pitch detecting part 203A calculates the autocorrelation values of a sequence of speech waveforms in memory areas A1-A5 while sequentially shifting the sample point, and detects the distance between the peaks of the autocorrelation value as the pitch length. By providing memory areas A1-A5 for a plurality of past frames as shown in FIG. 2, the pitch of a speech signal can be detected even if it is longer than a frame, provided that it is shorter than or equal to a length equal to 5 frames.

Figure 3B:
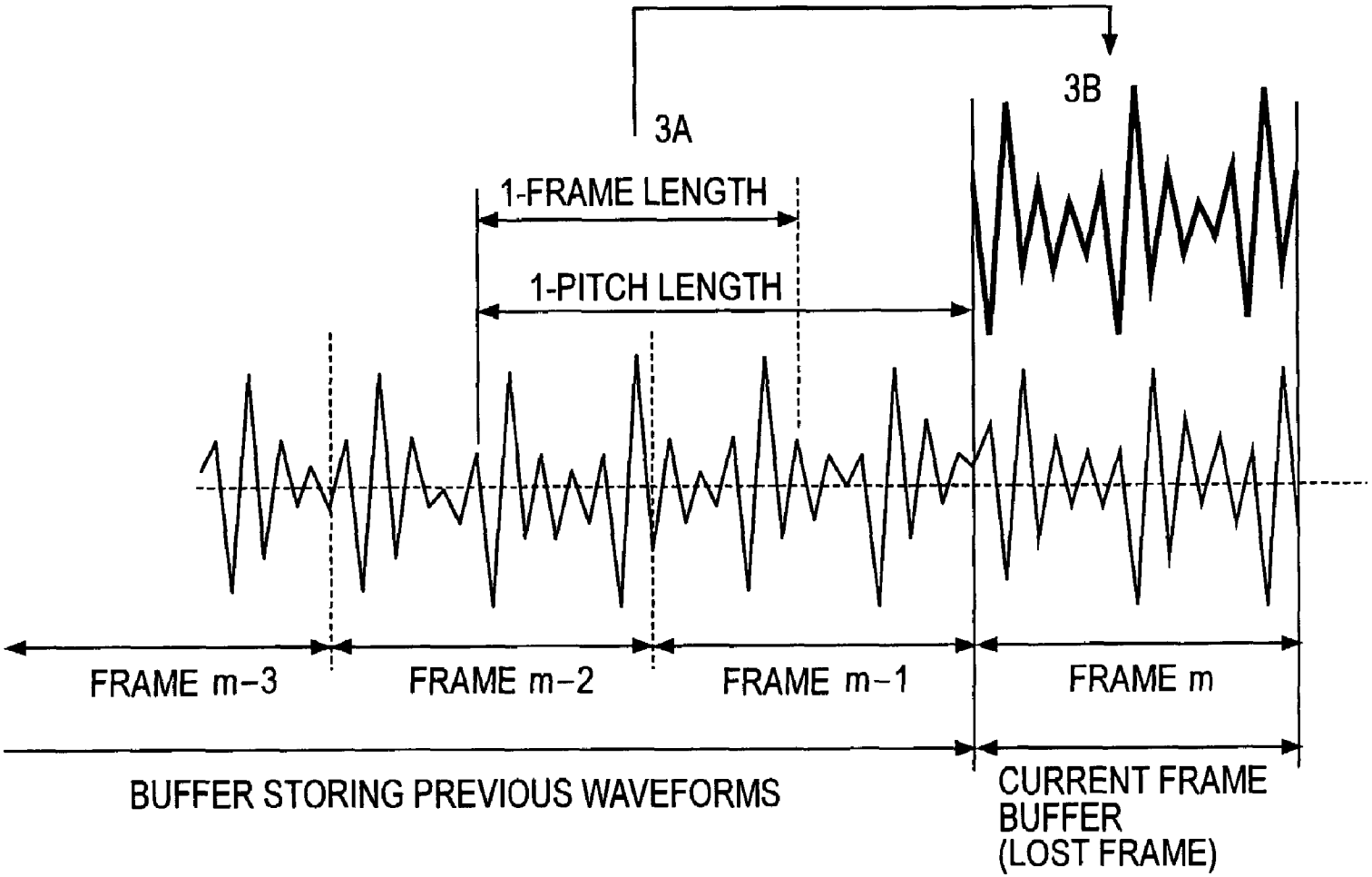
FIG. 3B is a diagram for describing a method for synthesizing waveform in a case where a pitch is longer than a frame.

FIG. 3A schematically shows an exemplary waveform in a period from the current frame m to a midpoint in a past frame, m−3, of speech waveform data written in memory areas A0-A5. The waveform cutout part 203B copies a waveform 3A of the detected pitch length from the frame preceding the current frame and pastes it repeatedly as waveforms 3B, 3C, and 3D in the forward direction as shown in FIG. 3A until the one frame length is filled, thereby synthesizing a compensatory speech signal for the current frame. In general, since the length of a frame is not necessarily an integral multiple of a pitch length, the last copy of the waveform is truncated so as to fit into the remaining segment of the frame. As shown in FIG. 3B for example, if the detected pitch length is longer than one frame length, a waveform 3A of one frame length starting at earlier end of one pitch length of the waveform directly preceding the current frame is copied, and the copied waveform 3B is used as a compensatory speech signal for the current frame.

Figure 4:
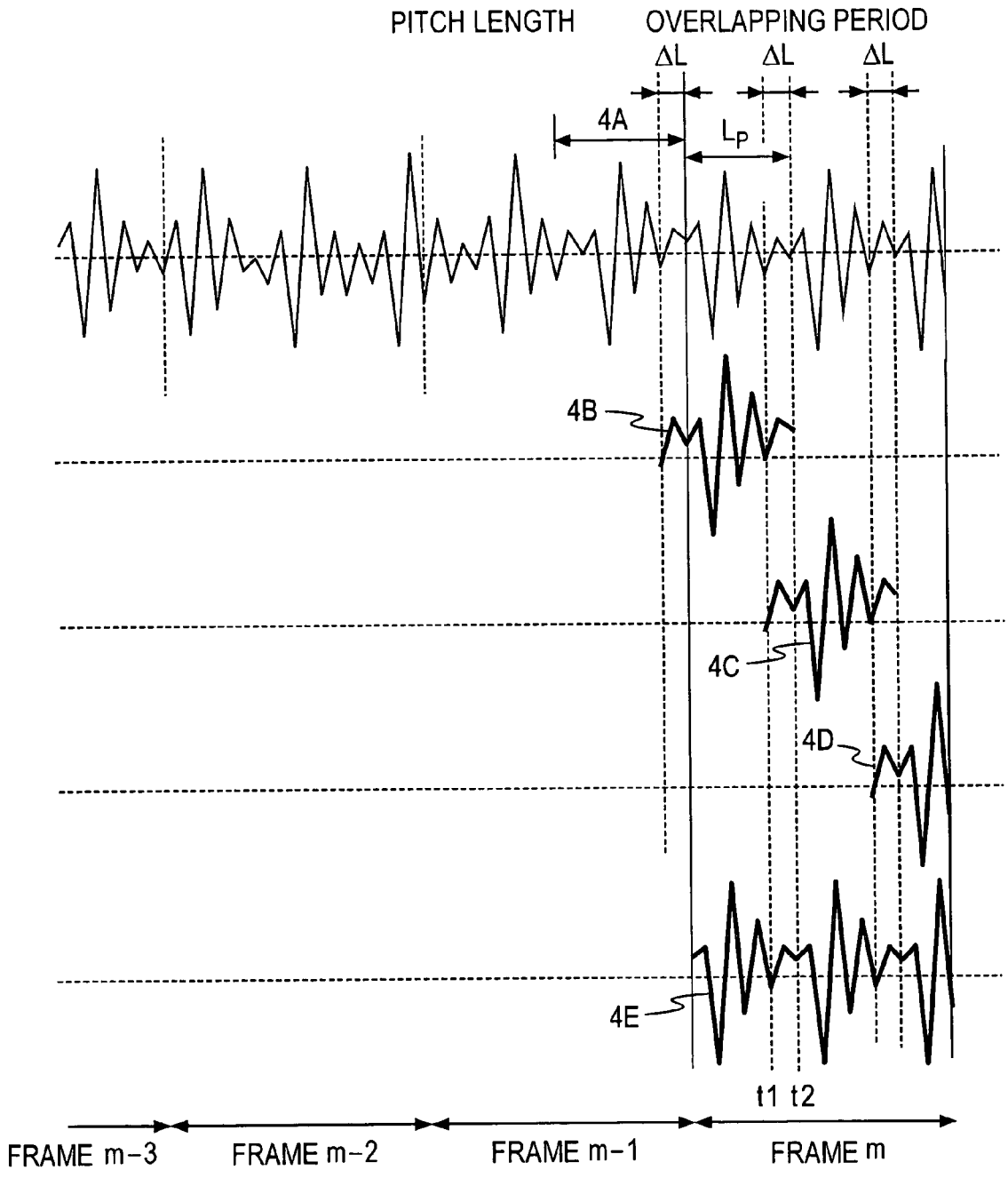
FIG. 4 is a diagram for illustrating another exemplary method for synthesizing a waveform.
Figure 5A:
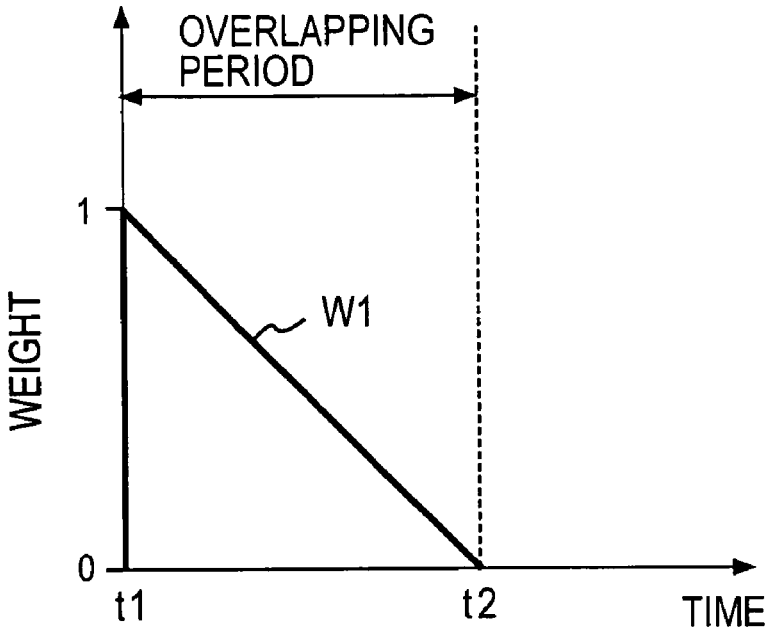
FIG. 5A shows an example of one of weighting functions for concatenating waveforms in FIG. 4
Figure 5B:
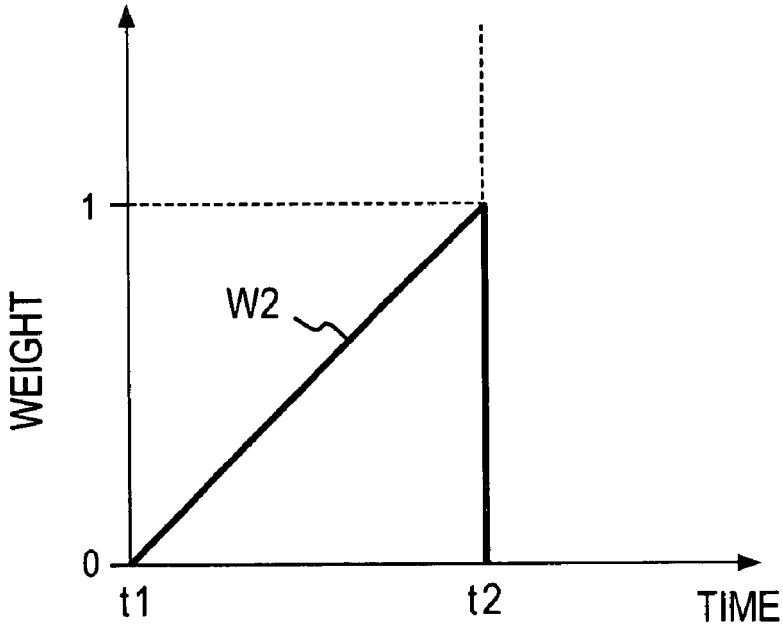
FIG. 5B shows an example of the other weighting function.

FIG. 4 shows another example of a method for synthesizing a compensatory speech signal. In this example, a waveform 4A which is ΔL longer than a detected pitch length is repeatedly copied to provide waveforms 4B, 4C, and 4D. The waveforms are arranged in such a manner that adjacent waveforms overlap at their ends by ΔL. The overlapping periods ΔL at the front and rear ends are multiplied by weighting functions W1 and W2 shown in FIGS. 5A and 5B, respectively, and the products are added together to concatenate the cutout waveforms in series. Thus, one frame length of waveform 4E can be produced. For example, in the overlapping period between time t1 and t2, the rear end portion ΔL of waveform 4B from time t1 to t2 is multiplied by the weighting function W1 which linearly decreases from 1 to 0 as shown in FIG. 5A, and the front end portion ΔL of waveform 4C in the same period is multiplied by the weighting function W2 which linearly increases from 0 to 1 as shown in FIG. 5B. These products of the sample values over the period from t1 to t2 are added together. The same operation is performed for the other overlapping periods.

In this way, the lost signal generating part 203 generates a compensatory speech signal for one frame on the basis of the speech signal in at least one directly preceding frame and provides it to a speech quality evaluating part 40. The compensatory speech signal generating algorithm used in the lost signal generating part 203 may be the one described in Non-patent literature 4 for example or other algorithm.

Returning to FIG. 1, the speech signal (original speech signal) from the input terminal 100, the output signal from the decoder 12, and the output signal from the compensatory speech generating part 20 are provided to the speech quality evaluating part 40, where a duplication level Ld for the packet is determined.

Figures 6, 7, 8:
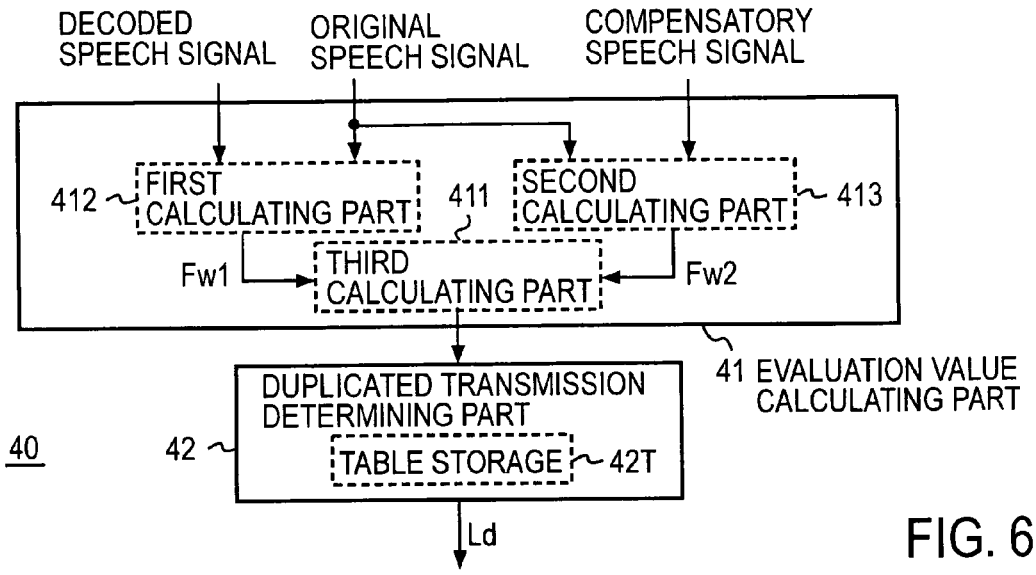
FIG. 6 is a block diagram showing a specific exemplary functional configuration of a speech quality evaluating part 40 shown in FIG. 1.
FIG. 7 shows an exemplary table defining the relation between speech quality evaluation values and duplication levels.
FIG. 8 shows another exemplary table defining the relation between speech quality evaluation values and duplication levels.

FIG. 6 shows a specific example of the speech quality evaluating part 40. First, an evaluation value representing the quality of the compensatory speech signal is calculated in an evaluation value calculating part 41. Here, a first calculating part 412 calculates an objective evaluation value Fw1 of the decoded speech signal of the current frame with respect to the original speech signal of the current frame from the input speech signal (original speech signal) provided through the input terminal 100 and the output signal (decoded speech signal) of the decoder 12. Similarly, a second calculating part 413 calculates an objective evaluation value Fw2 of the compensatory speech signal with respect to the original speech signal from the input speech signal (original speech signal) of the current frame and the signal (compensatory speech signal) for the current frame outputted from the compensatory speech generating part 20 which was generated from the decoded speech signal of the past frame. Specifically, the objective evaluation values Fw1 and Fw2 calculated by the first calculating part 412 and the second calculating part 413 may be SNR (Signal to Noise Ratio), for example. Here, the first calculating part 412 uses the power Porg of the original speech signal of one frame as signal S and uses the power Pdif1 of the difference between the original speech signal and the decoded speech signal of one frame (the sum of the squares of the difference between the values of corresponding samples of the two signals over one frame) as noise N to compute $$Fw1=10\log(S/N)=10\log(Porg/Pdif1) \quad (1)$$

Letting N denote the number of the samples in each frame and $x_n$ and $y_n$ denote the n-th sampled values of the original speech signal and the decoded speech signal, respectively, of the frame, then $Porg=\Sigma x_n^2$ and $Pdif1=\Sigma(x_n-y_n)^2$. Here, Σ represents the sum for samples 0 to N−1 in the flame. Similarly, the second calculating part 413 uses the power Porg of the original speech signal of one frame as signal S and the power Pdif2 of the difference between the original speech signal and the compensatory speech signal as noise N to compute as the objective evaluation value Fw2

$$Fw2=10\log(S/N)=10\log(Porg/Pdif2) \quad (2)$$

Here, letting the n-th sampled value of the compensatory speech signal of the frame be $z_n$, then $Pdif2=\Sigma(x_n-z_n)^2$.

Instead of signal to noise ratio (SNR), other evaluation value may be used such as WSNR (Weighted Signal to Noise Ratio; see for example Non-patent document 5, J. Nurminen, A. Heikkinen & J. Saarinen, "Objective evaluation of methods for quantization of variable-dimension spectral vectors in WI speech coding", in Proc. Eurospeech 2001, Aalborg, Demark, September 2001, pp. 1969-1972) or SNRseg (Segmental SNR, which can be obtained by dividing each frame into segments and averaging SNR values over the segments), WSNRseg, CD (cepstrum distance: here the cepstrum distance between the original speech signal Org and the decoded speech signal Dec obtained at the first calculating part 412, hereinafter denoted as CD (Org, Dec), corresponding to distortion), or PESQ (the comprehensive evaluation measure specified in ITU-T standard P.862). The objective evaluation value is not limited to one type; two or more objective evaluation values may be used in combination.

A third calculating part 411 uses one or more objective evaluation values calculated by the first calculating part 412 and the second calculating part 413 to compute an evaluation value representing the speech quality of the compensatory speech signal and sends it to a duplicated transmission determining part 42. Based on the evaluation values, the duplicated transmission determining part 42 determines a duplication value Ld, which is an integer value. The lower the speech quality of the compensatory speech signal, the larger the integer value. That is, one of duplication levels Ld, which are discrete values, is chosen based on a value representing speech quality obtained as the evaluation value. If WSNR is used as the objective evaluation value, the duplication level Ld of a packet may be determined by using the sum of squares of a perceptional weighted difference signal, $WPdif1=\Sigma[WF(x_n-y_n)]^2$, as the power of difference Pdif1 in Equation (1), instead of $Pdif1=\Sigma(x_n-y_n)^2$. $WF(x_n-y_n)$ represents perceptional weighting filtering applied to the difference signal $(x_n-y_n)$. The coefficient of the perceptional weighting filter can be determined from the linear predictive coefficient of the original speech signal. The same applies to Equation (2).

It is effective that the WSNR outputs obtained at the first and second calculating parts 412 and 413 are used as Fw1 and Fw2, respectively, to compute Fd=Fw1−Fw2 at a third calculating part 411, which is then inputted into a duplicated transmission determining part 42 as the evaluation value, and a table as shown in FIG. 7 is referenced to determine a duplicated level Ld from the value of Fd. That is, the duplication level Ld is increased as the value Fd obtained by subtracting the evaluation value Fw2 of the compensatory speech signal with respect to the original speech signal from the evaluation value Fw1 of the decoded speech signal with respect to the original speech signal increases. The larger the value Fd=Fw1−Fw2 is, the lower the speech quality of the compensatory speech signal with respect to the decoded speech signal becomes. Therefore, in order to maximize the probability that such a frame of speech signal will arrive at the receiving end, the number of duplicated packets transmission of the same frame is increased. In contrast, if Fd=Fw1−Fw2 is small, the quality of the reproduction speech signal at the receiving end would be less degraded even if a packet loss has occurred and a compensatory speech signal is substituted for the speech signal of the frame. Therefore, if Fd=Fw1−Fw2 is small, a small number of duplicated packet transmissions Ld of the same frame is chosen. If Ld=1, the packet of the same frame is transmitted only once (that is, duplicated transmission is not performed). The table in FIG. 7 is prepared beforehand based on experiments and stored in a table storage 42T in the duplicated transmission determining part 42.

Figures 9, 10, 11:
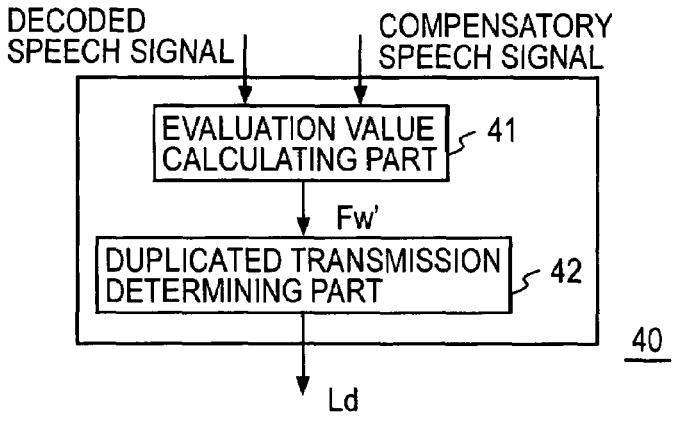
FIG. 9 shows yet another exemplary table defining the relation between speech quality evaluation values and duplication levels.
FIG. 10 shows another exemplary configuration of the speech quality evaluating part 40 shown in FIG. 1.
FIG. 11 shows an exemplary table defining the relation between speech quality evaluation values and duplication levels in a case where the speech quality evaluating part shown in FIG. 10 is used.

Plural objective evaluation values of different types may be used. For example, if the values of WSNR and CD are to be used as the objective evaluation values, it is effective that the first calculating part 412 also calculates CD (Org, Dec) and provides the calculated CD to the duplicated transmission determining part 42 as Fd1 along with Fd=Fw1−Fw2, and a duplication level Ld is determined from the value Fd with reference to a table shown in FIG. 8. If the distortion Fd1=CD (Org, Dec) of the decoded speech signal with respect to the original speech signal is small, the value of duplication level Ld is increased as Fd=Fw1−Fw2 increases, as described above. On the other hand, a large value of Fd1 indicates that the frame does not provide high speech quality even if there is no packet loss. Accordingly, a high duplication level Ld is not profitable, therefore only two low Ld values are provided and choice is made between only the two Ld levels based on the value of Fd=Fw1−Fw2. The cepstrum distance CD (Dec, Com) of the compensatory speech signal Com with respect to the decoded speech signal Dec may be calculated in the evaluation value calculating part 41 and the resulting value Fd2 may also be used to determine the duplication level Ld. FIG. 9 shows an example of the table used for this purpose. In this example, the range of Fd=Fw1−Fw2<2 dB and the range of 2 dB≦Fd<10 dB of the table in FIG. 8 are replaced with one range, Fd<10 dB, and this range is divided into two Fd2 ranges, one is less than 1 and the other greater than or equal to 1.

The packet generating part 15 in FIG. 1 generates as many duplications of the coded speech signal received from the encoder 11 as the number equal to the packet duplication level received from the speech quality evaluating part 40 and sends the Ld number of generated packets to a transmitting part 16, which then transmits the packets to the network. If Ld=1, then only one packet is transmitted without duplication.

In the example described with respect to FIG. 6, the evaluation value calculating part 41 uses as an objective evaluation value two evaluation values, namely the evaluation value Fw1 obtained from the power Porg of the original speech signal and the power of the difference Pdif1 between the original speech signal and the decoded speech signal by using Equation (1) and the evaluation value Fw2 obtained from the power Porg of the original speech signal and the power of the difference Pdif2 between the original speech signal and the compensatory speech signal by using Equation (2), to determine the duplication level Ld. However, the objective evaluation value may be determined from only the decoded speech signal and the compensatory speech signal as shown in another example of the speech quality evaluating part 40 in FIG. 10. In particular, the evaluation value calculating part 41 calculates the evaluation value Fw' from the power Pdec of the decoded speech signal and the power of the difference Pdif' between the decoded speech signal and the compensatory speech signal according to the following equation $$Fw'=10\log(Pdec/Pdif') \quad (3)$$

This indicates that as the power of the difference Pdif' increases, the evaluation value Fw' decreases and correspondingly the speech quality of the compensatory speech signal deteriorates. In a table in the duplicated transmission determining part 42, duplication levels Ld based on the evaluation value Fw' are specified as shown in FIG. 11, in which if the evaluation value Fw' is less than 2 dB, then Ld=1, if 2 dB≦Fw'<10 dB, then Ld=2, and if Fw'≧10 dB, then Ld=3. The table is prepared beforehand based on experiments.

Figure 12:
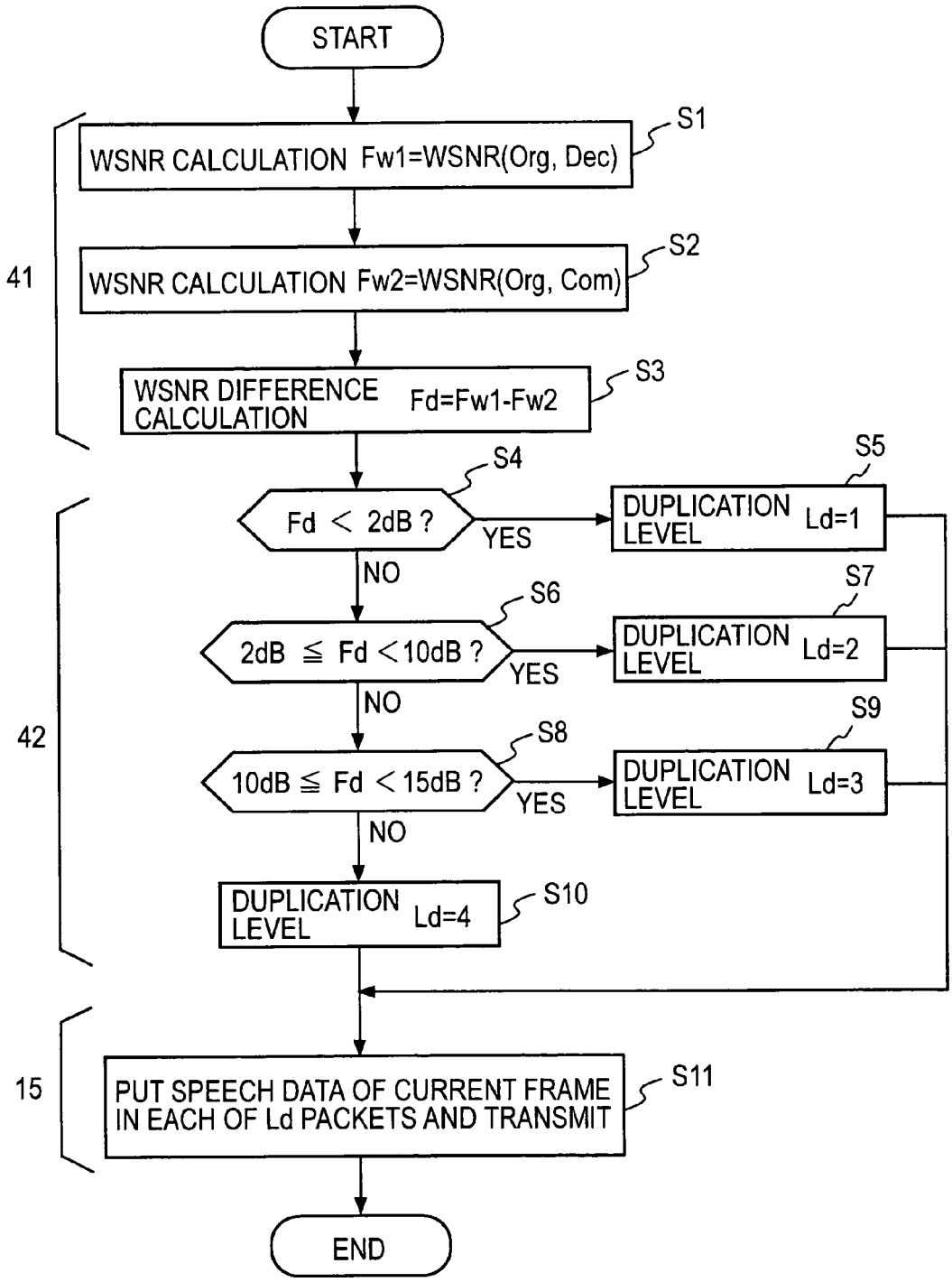
FIG. 12 is a flowchart of a process performed by the speech quality evaluating part 40 and a packet generating part 105 shown in FIG. 1.

FIG. 12 shows a process performed by the speech quality evaluating part 40 and the packet generating part 15 in FIG. 1 in the transmitting apparatus for determining the duplication level Ld through the use of the table shown in FIG. 7. Here, weighted signal to noise ratio WSNR is used as the objective evaluation value. In the following process, steps S1 to S3 are performed by the evaluation value calculating part 41, steps S4 to S10 are performed by the duplicated transmission determining part 42, and step S11 is performed by the packet generating part 15.

Step S1: In the evaluation value calculating part 41, WSNR=10 log(Porg/WPdif1) is obtained as an evaluation value Fw1 from the power Porg of an original speech signal Org and the power WPdif1 of a perceptional weighted difference signal between the original speech signal Org and a decoded speech signal Dec. This calculation is hereinafter denoted as Fw1=WSNR(Org, Dec).

Step S2: In the evaluation value calculating part 41, WSNR=10 log(Porg/WPdif2) is obtained as an evaluation value Fw2 from the power Porg of the original speech signal and the power WPdif2 of a perceptional weighted difference signal between the original speech signal and the compensatory speech signal Com. This calculation is hereinafter denoted as Fw2=WSNR(Org, Ext).

Step S3: Difference Fd=Fw1−Fw2 is obtained.

Step S4: In the duplicated transmission determining part 42, determination is made as to whether Fd<2 dB. If Fd is smaller than 2 dB, then it is determined that Ld=1 at step S5; otherwise, the process proceeds to step S6.

Step S6: Determination is made as to whether 2 dB≦Fd<10 dB. If so, it is determined from the table shown in FIG. 7 that Ld=2 at step S7; otherwise, the process proceeds to step S8.

Step S8: Determination is made as to whether 10 dB≦Fd<15 dB. If so, it is determined from the table shown in FIG. 7 that Ld=3 at step S9; otherwise, it is determined that Ld=4 at step S10.

Step S11: The packet generating part 15 puts the same speech data of the current frame in each of the Ld number of packets and sends them sequentially.

Figure 13:
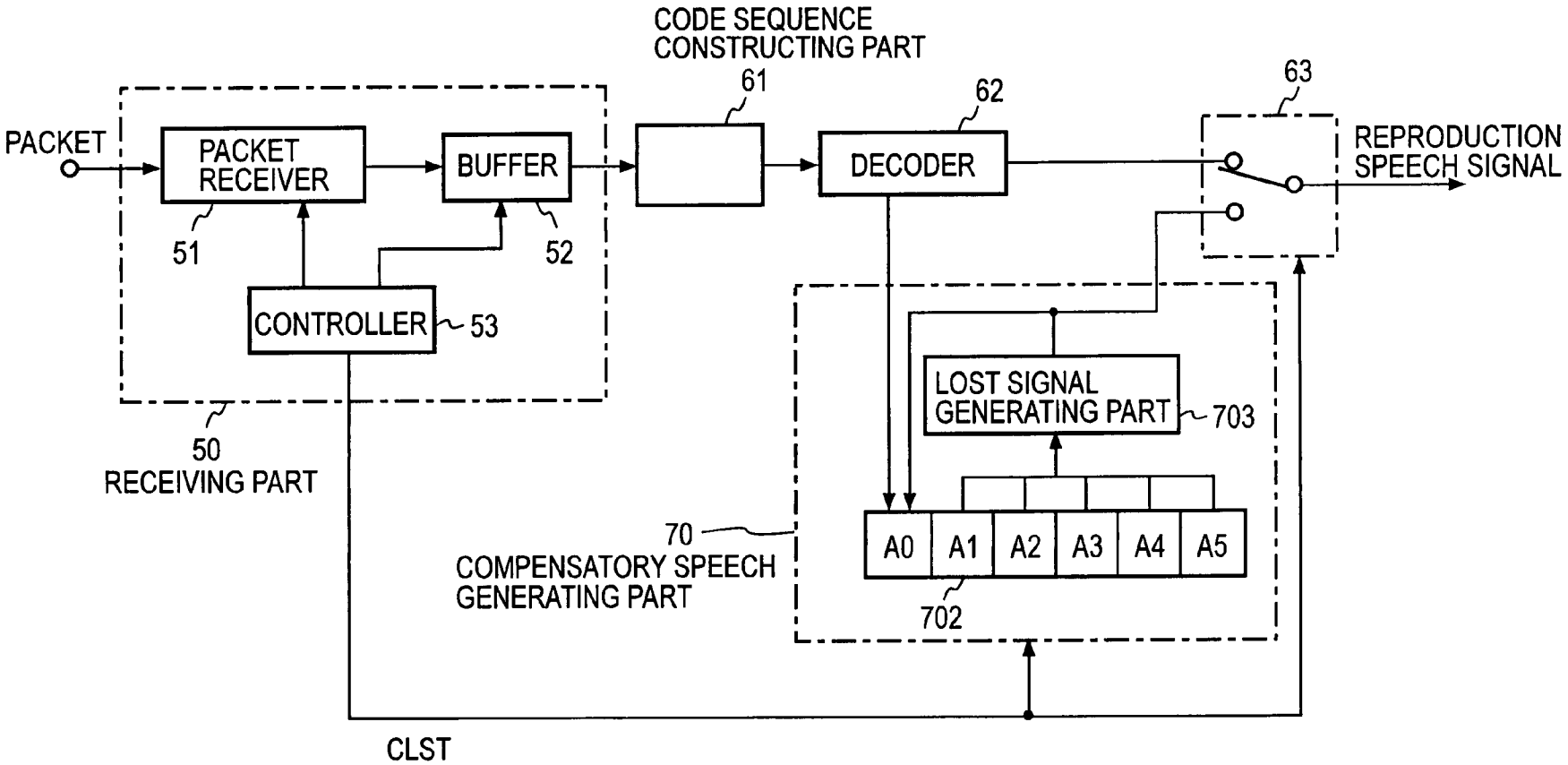
FIG. 13 is a block diagram showing an exemplary functional configuration of a receiving apparatus associated with the transmitting apparatus shown in FIG. 1.

FIG. 13 shows a functional configuration of a speech packet receiving apparatus associated with the speech packet transmitting apparatus shown in FIG. 1. The receiving apparatus includes a receiving part 50, a code sequence constructing part 61, a decoder 62, a compensatory speech generating part 70, and an output signal selector 63. The receiving part 50 includes a packet receiver 51, a buffer 52, and controller 53. The controller 53 checks the buffer 52 to see if it stores a packet containing speech data with the same frame number as that of the speech data contained in a packet received at the packet receiver 51. If it is already stored, the controller 53 discards the received packet; otherwise, the controller 53 stores the received packet in the buffer 52.

The controller 53 searches through the buffer 52 for a packet containing the speech data with each frame number, in the order of frame number. If the packet is found, the controller 53 extracts the packet and provides it to the code sequence constructing part 61. The code sequence constructing part 61 extracts one frame length of coded speech signal from the packet provided, sorts the parameter codes constituting the coded speech signal in a predetermined order, and then provides the coded speech signal to the decoder 62. The decoder 62 decodes the provided coded speech signal to generate one frame length of speech signal and provides it to the output selector 63 and the compensatory speech generating part 70. If the buffer 52 does not contain a packet containing the coded speech signal of the current frame, the controller 53 generates a control signal CLST indicating packet loss and provides it to the compensatory speech generating part 70 and the output signal selector 63.

The compensatory speech generating part 70, which has substantially the same configuration as that of the compensatory speech generating part 20 in the transmitting apparatus, includes a memory 702 and a lost signal generating part 703. The lost signal generating part 703 also has a configuration similar to that of the lost signal generating part 203 at the transmitting end shown in FIG. 2. When a coded speech signal is provided from the decoder 62, the compensatory speech generating part 70 shifts the speech signal in areas A0-A4 to areas A1-A5 in the memory 702 and writes the provided decoded speech signal into area A0 unless control signal CLST is provided. Then, the coded speech signal selected by the output signal selector 63 is outputted as a reproduction speech signal.

If packet loss is detected and control signal CLST is generated by the controller 53, the packet of the current frame cannot be obtained from the buffer 52. Therefore, the compensatory speech generating part 70 shifts the speech signal in areas A0-A4 to areas A1-A5 in the memory 702, and the lost signal generating part 703 generates a compensatory speech signal based on the shifted speech signal, writes it in area A0 in the memory 702, and also outputs it as a reproduction speech signal through the output signal selector 63.

Figure 14A:
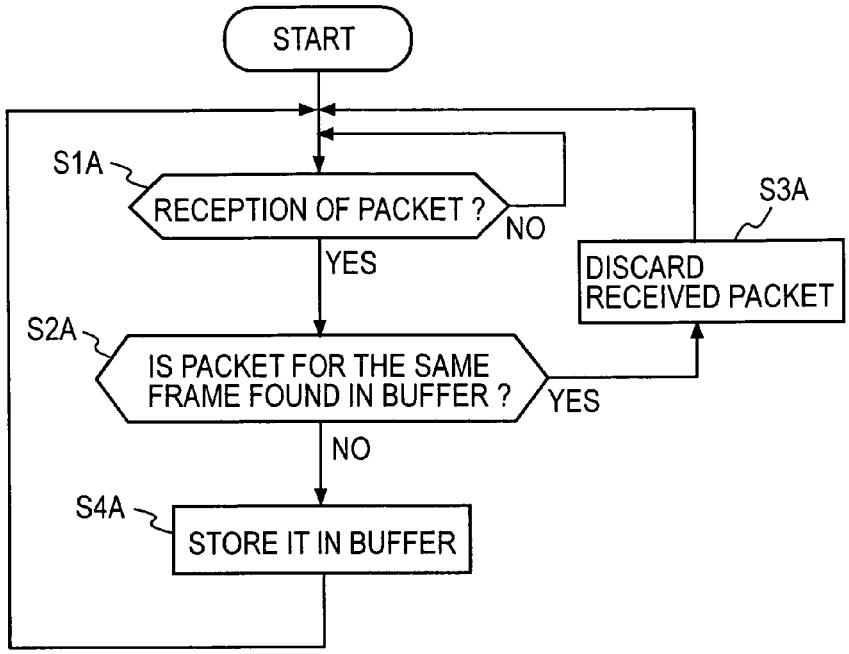
FIG. 14A is a flowchart of a process for processing a received packet in FIG. 13.
Figure 14B:
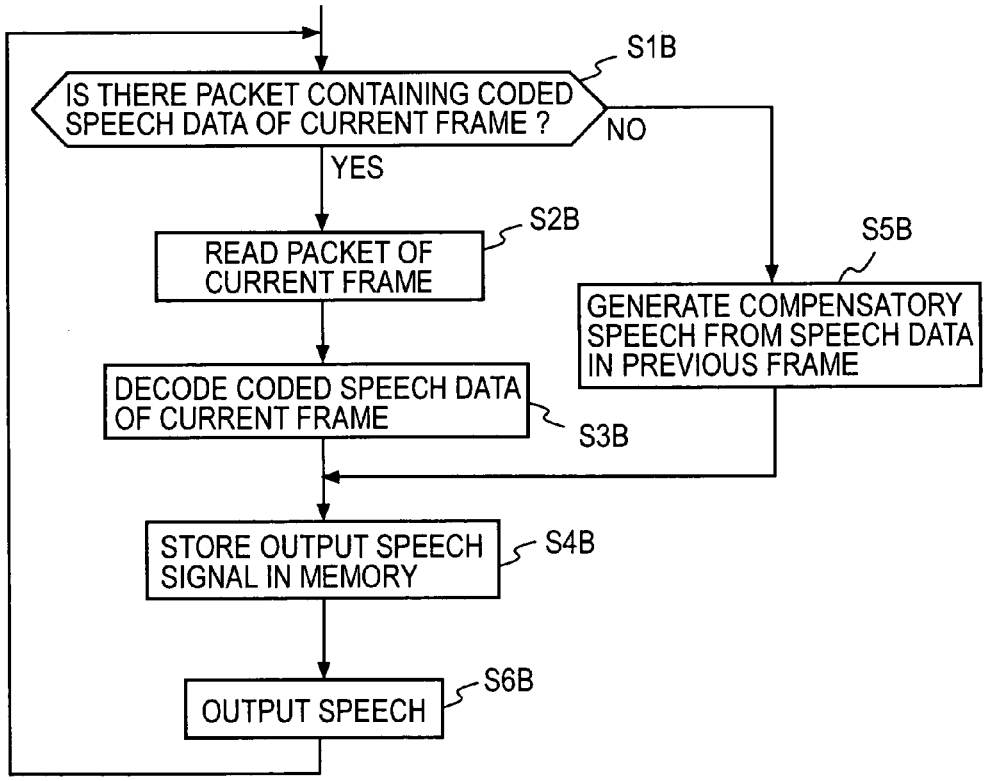
FIG. 14B is a flowchart of a process for generating reproduction speech in FIG. 13.

FIGS. 14A and 14B show a packet receiving process and a speech signal reproducing process performed in the receiving apparatus shown in FIG. 13. In the packet receiving process, determination is made at step S1A in FIG. 14A as to whether a packet has been received or not. If a packet is received, determination is made at step S2A as to whether or not a packet containing the speech data having the same frame number as that of the speech data contained in the packet is already stored in the buffer 52. If a packet containing the speech data with the same frame number is found, the received packet is discarded at step S3A and the process waits for the next packet at step S1A. If a packet containing the speech data with the same frame number is not found in the buffer 52, then the received packet is stored in the buffer 52 at step S4A and the process returns to step S1A, where the process waits for the next packet.

In the speech signal reproducing process, determination is made at step S1B in FIG. 14B as to whether a packet containing the speech data of the current frame is stored in the buffer 52. If it is stored, then the packet is extracted and provided to the code sequence constructing part 61 at step S2B. The code sequence constructing part 61 extracts a coded speech signal, which is the speech data of the current frame, from the provided packet, sorts the parameter codes constituting the coded speech signal in a predetermined order, and then provides the signal to the decoder 62. The decoder 62 decodes the coded speech signal to generate a speech signal at step S3B. The speech signal is stored in the memory 702 at step S4B and outputted at step S6B. If a packet containing the speech data of the current frame is not found in the buffer 52 at step S1B, a compensatory speech signal is generated from the speech signal of the previous frame at step S5B, the generated compensatory speech signal is stored in the memory 702 at step S4B, and is outputted at step S4B.

Second Embodiment

FIG. 15 shows a functional configuration of a speech packet transmitting apparatus according to a second embodiment of the present invention. In this embodiment, the encoder 11 and decoder 12 given in the first embodiment are not provided. An input PCM speech signal is directly packetized and sent. A compensatory speech generating part 20 generates a compensatory speech signal from an input PCM speech signal provided through an input terminal 100. The process performed by the compensatory speech signal generating part 20 is the same as the one shown in FIG. 2. The compensatory speech signal generated here is sent to the speech quality evaluating part 40. The speech quality evaluating part 40 determines a duplication level Ld for the packet and outputs it to a packet generating part 15.

FIG. 16 shows a specific example of the speech quality evaluating part 40. Here, an evaluation value calculating part 41 calculates an objective evaluation value of a compensatory speech signal outputted from the compensatory speech generating part 20 with respect to the input PCM original speech signal of the current frame provided through the input terminal 100. The objective evaluation value may be an evaluation value such as SNR, WSNR, SNRseg, WSNRseg, CD, or PESQ, etc. The objective evaluation value is not limited to one type; two or more evaluation values may be used in combination. The objective evaluation value calculated in the evaluation value calculating part 41 is sent to a duplicated transmission determining part 42, where a duplication level Ld for the packet is determined. As for determination of a duplication level Ld, it is effective, in the case of using WSNR as the objective evaluation value for example, to determine the duplication level Ld of a packet by using WSNR output from the evaluation value calculating part 41 as Fw as shown in FIG. 17. In that case, the larger the evaluation value Fw becomes, the smaller the duplication level Ld will be chosen. In this example, a table as shown in FIG. 17 is provided in the duplicated transmission determining part 42. In this case, the evaluation value calculating part 41 calculates WSNR by using the power of the original speech signal as signal S and the power of a weighted difference signal between an original speech signal and a compensatory speech signal as noise N. If WSNR is large, speech quality is not significantly degraded by using a compensatory speech signal for a lost packet. Therefore, the larger the WSNR, the smaller duplication level Ld will be chosen.

The packet generating part 15 generates as many duplications of an input PCM speech signal of a frame size to be processed as the number equal to the packet duplication level Ld received from the speech quality evaluating part 40 and sends the Ld number of generated packets to a transmitting part 16, which then transmits the packets to the network.

Figure 18:
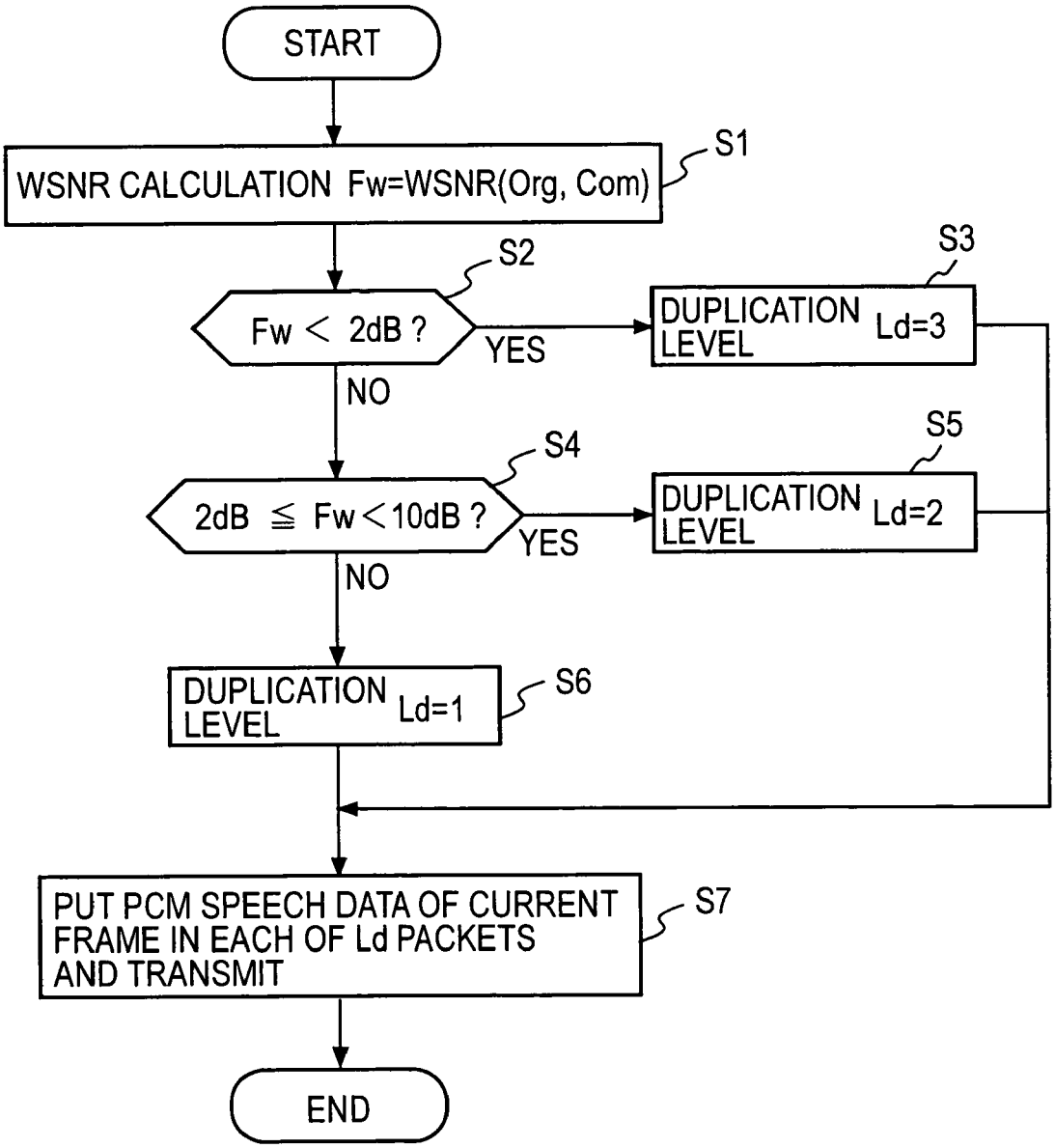
FIG. 18 is a flowchart of a process performed by the speech quality evaluating part 40 and the packet generating part 15 in the transmitting apparatus shown in FIG. 15.

FIG. 18 shows a process for determining a duplication level Ld by the speech quality evaluating part 40 shown in FIG. 16 by using the table in FIG. 17 and a procedure of packet generation process performed by the packet generating part 15 in the transmitting apparatus shown in FIG. 15. Again, the example uses a weighted signal to noise ratio WSNR as the evaluation value Fw. At step S1, an evaluation value Fw is calculated from the power Porg of an original speech signal Org and the power WPdif of a perceptional weighted difference signal between the original speech signal Org and a compensatory speech signal Com as $$WSNR = 10\log(Porg/WPdif)$$

This calculation is hereinafter denoted as Fw=WSNR(Org, Com). Determination is made at step S2 whether or not the evaluation value Fw is less than 2 dB. If so, it is determined from the value of FW with reference to the table shown in FIG. 17 that the duplication level Ld=3 at step S3. If Fw is not less than 2 dB, determination is made at step S4 as to whether or not Fw is greater than or equal to 2 dB and less than 10 dB. If so, it is determined with reference to the table shown in FIG. 17 at step S5 that Ld=2. Otherwise, it is determined at step S6 that Ld=1. At step S7, the packet generating part 15 puts the speech signal of the current frame into each of the Ld number of packets according to the determined duplication level Ld and provides the packets to the transmitting part 16, which then sequentially transmits the packets.

Figure 19:
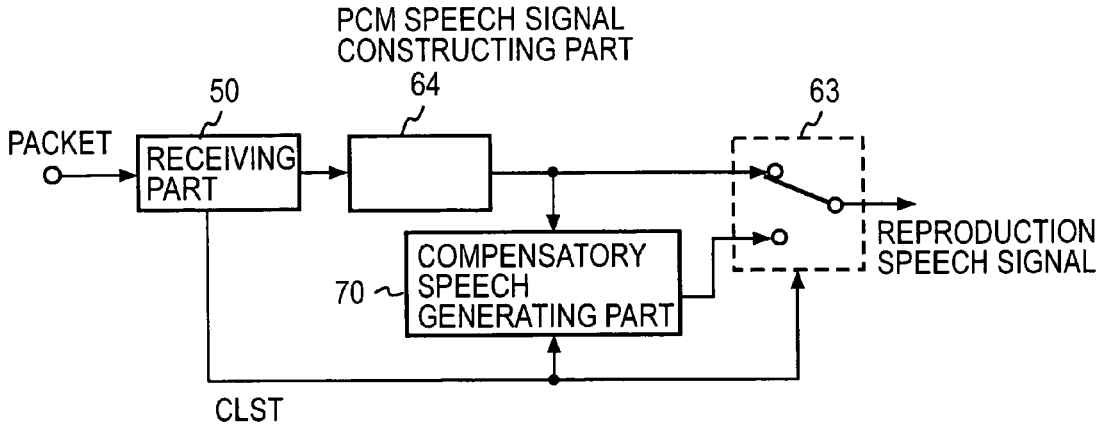
FIG. 19 is a block diagram showing an exemplary functional configuration of a speech packet receiving apparatus associated with the speech packet transmitting apparatus shown in FIG. 15.

FIG. 19 shows a packet receiving apparatus associated with the transmitting apparatus shown in FIG. 15. A receiving part 50 and a compensatory speech generating part 70 have configurations similar to those of the receiving part 50 and the compensatory speech generating part 70 shown in FIG. 13. In this example, a PCM speech signal constructing part 64 extracts a PCM output speech signal sequence from packet data received at the receiving part 50. Packets are redundantly sent from the sending end. If duplicated packets are received at the receiving part 50, the second and subsequent duplicated packets are discarded. If a packet is successfully received, the PCM speech signal constructing part 64 extracts a PCM speech signal from the packet and sends it to an output signal selector 63 and, at the same time, stores it in a memory in the compensatory speech generating part 70 (see FIG. 13) for generating a compensatory speech signal for subsequent frames. If occurrence of packet loss is indicated from the receiving part 50 with a control signal CLST, the compensatory speech generating part 70 generates a compensatory speech signal in a manner similar to the process described with reference to FIG. 2 and sends it to the output signal selector 63. If occurrence of packet loss is indicated from the receiving part 50, the output signal selector 63 selects a compensatory speech signal output from the compensatory speech generating part 70 as an output speech signal and outputs it. If there is not packet loss, the selector 63 selects an output from the PCM speech signal constructing part 64 as an output speech signal and outputs it.

Third Embodiment

Figure 20:
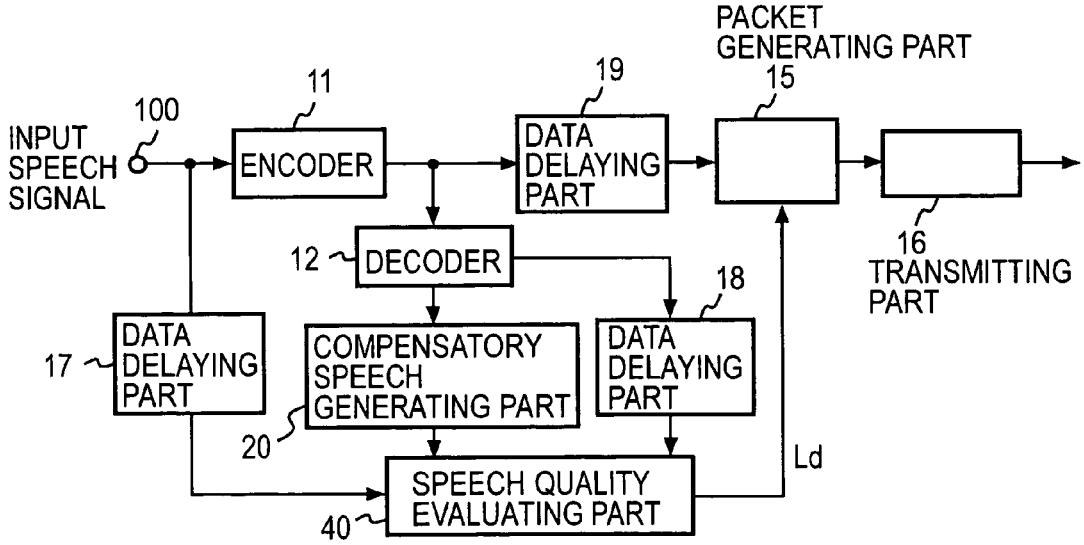
FIG. 20 is a block diagram showing an exemplary functional configuration of a speech packet transmitting apparatus according to a third embodiment of the present invention.

While extrapolation is used to generate a compensatory speech signal from a past frame or frames in the embodiments described above, interpolation is used to generate a compensatory speech signal from the waveforms in frames preceding and succeeding the current frame in a third embodiment. FIG. 20 shows a functional configuration of a speech packet transmitting apparatus according to the third embodiment of the present invention. The configuration and operation of an encoder 11, decoder 12, speech quality evaluating part 40, a packet generating part 15, and transmitting part 16 are the same as their equivalents in the embodiment shown in FIG. 1. The third embodiment is configured so that a compensatory speech signal for the speech signal of the current frame is generated from the speech signal of the past frame and the speech signal of the frame that follows the current frame by using interpolation.

A coded speech coded in the encoder 11 is sent to a data delaying part 19 which provides 1-frame-period delay and also sent to the decoder 12 at the same time. The speech signal decoded in the decoder 12 is provided to the speech quality evaluating part 40 through a data delaying part 18 which provides 1-frame-period delay and also sent to a compensatory speech generating part 20, where a compensatory speech is generated on the assumption that packet loss would have occurred in the frame preceding the current frame. Provided to the speech quality evaluating part 40 are an original speech signal delayed by one frame period by a data delaying part 17 as well as a compensatory speech signal from the compensatory speech generating part 20 and a decoded signal from the data delaying part 18, and a duplication level Ld is determined in a manner similar to the embodiment in FIG. 1.

Figure 21:
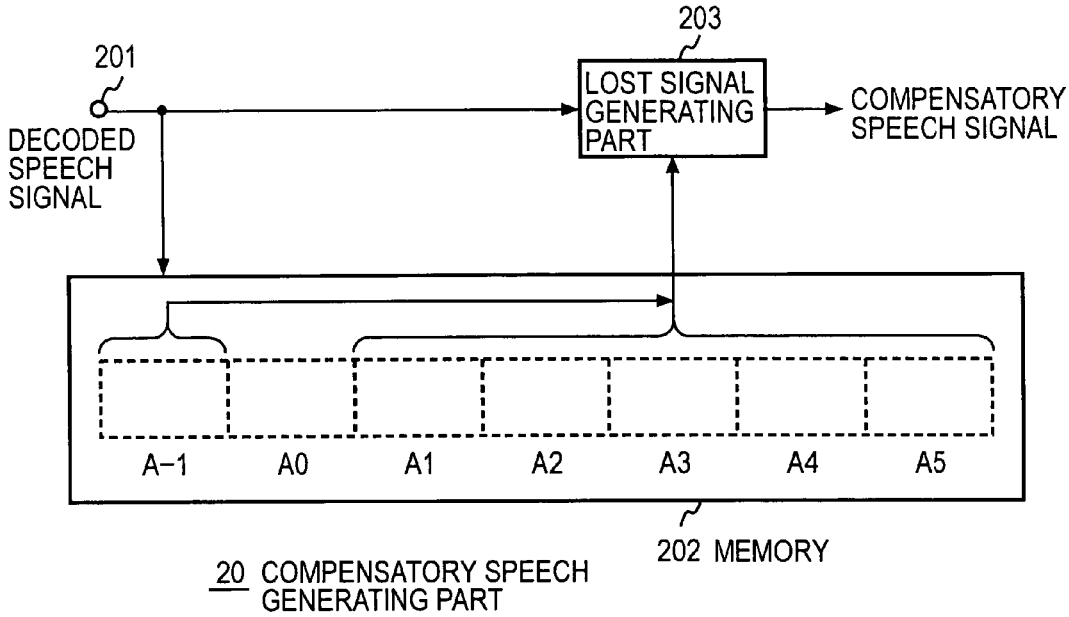
FIG. 21 is a block diagram showing a specific exemplary functional configuration of a compensatory speech generating part 20 shown in FIG. 20.
Figure 22:
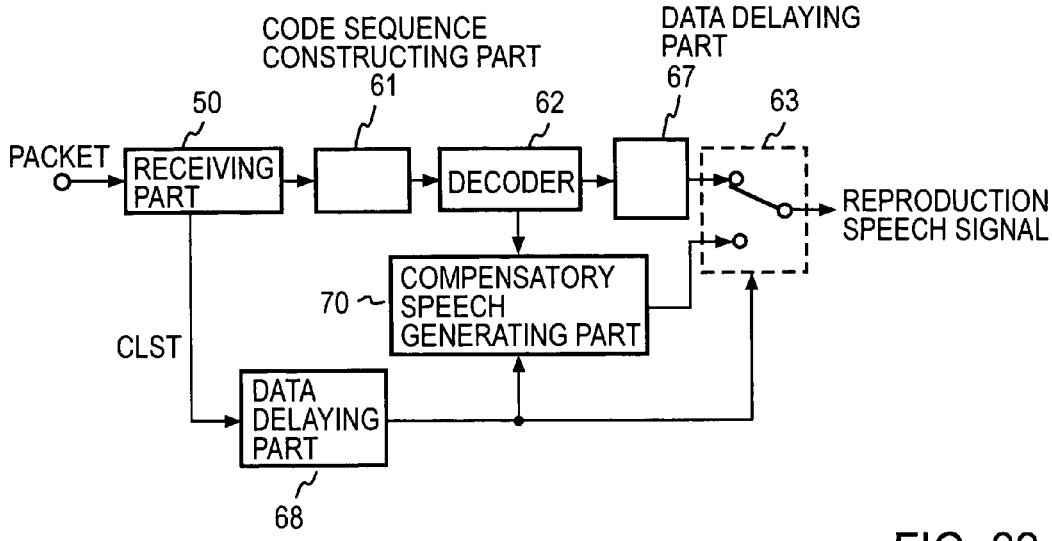
FIG. 22 is a block diagram showing an exemplary functional configuration of a receiving apparatus associated with the transmitting apparatus shown in FIG. 20.

FIG. 21 shows a specific example of the compensatory speech generating part 20 which uses interpolation. A decoded speech signal is copied to area A-1 in a memory 202. One frame of decoded speech signal stored in each of area A-1 and areas A1-A5 in the memory 202, excluding area A0, is inputted into a lost signal generating part 203. In this case, a compensatory speech signal for a speech signal of a frame whose packet has been lost is generated for the frame by using an advance-readout future decoded speech signal and a past decoded speech signal. The lost signal generating part 203 generates, for the speech signal of the current frame to be sent, a compensatory speech signal from a past decoded speech signal (5 frames in this embodiment) and an advance-readout future decoded speech signal (one frame in this embodiment) for the current frame, and outputs it.

Specifically, the speech signal in areas A1-A5, for example, is used to detect a pitch length as in the example shown in FIG. 3A, and a waveform of the pitch length is cut out in the backward direction from the end point of area A1 (the border with the current frame), and duplications of this waveform are connected to generate an extrapolated waveform from the past. Similarly, a waveform of the pitch length is cut out in the forward direction from the starting point of area A0, duplications of this waveform are connected to generate an extrapolated waveform from the future. The samples corresponding to the two extrapolated waveforms are added together and the sum is divided by 2 to obtain an interpolated speech signal as the compensatory speech signal. Only waveforms with pitch lengths that are shorter than or equal to one frame length can be treated in this example because one frame length of memory area A-1 is provided for a future frame. However, it will be apparent that waveforms with pitch lengths longer than one frame length can be treated by providing multiple areas for multiple future frames. In that case, the amount of delay provided by the data delaying parts 17, 18, and 19 must be increased in accordance with the number of future frames. When the decoded speech signal of the next frame is inputted into the memory 202, the decoded speech signal stored in areas A-1, . . . , A4 is shifted one position to areas with larger area numbers, A0, . . . , A5.

In FIG. 20 the speech signal inputted through the input terminal 100 is fed into the data delaying part 17, where the speech signal is delayed by one frame period, and then is provided to the speech quality evaluating part 40. Also, the decoded speech signal from the decoder 12 is delayed by one frame period by the data delaying part 18 and then provided to the speech quality evaluating part 40. The original speech signal from data delaying part 17, the decoded speech signal from the data delaying part 18, and the compensatory speech signal from the compensatory speech generating part 20 are provided to the speech quality determining part 40, which then determines a packet duplication level Ld. The operation of the speech quality evaluating part 40 is the same as the operation described with reference to FIG. 6. Data delaying part 19 delays the coded speech signal provided from the encoder 11 by one frame period and then provides it to the packet generating part 15.

The speech signal decoded by the decoder 62 is sent to the data delaying part 67 and also is stored in a memory (not shown) in the compensatory speech generating part 70, which is similar to the memory shown in FIG. 21, for generating a compensatory speech signal for the subsequent frames. The data delaying part 67 delays the decoded speech signal by one frame and provides it to the output signal selector 63. If occurrence of packet loss is detected and a control signal CLST is outputted from the receiving part 50 to the data delaying part 68, the control signal CLST is delayed by one frame period and provided to the complementary speech generating part 70 and the output signal selector 63. The compensatory speech generating part 70 generates and outputs a compensatory speech signal in a manner similar to the operation described with reference to FIG. 21. If packet loss is indicated from the receiving part 50, the output signal selector 63 selects the output from the compensatory speech generating part 70 as the output speech signal. If packet loss does not occur, the output signal selector 63 selects the output from the data delaying part 67 as the output speech signal and outputs the decoded speech signal.

Fourth Embodiment

In the embodiments described above, if the speech quality of a compensatory speech signal generated for the speech signal of the current frame from at least one frame adjacent to the current frame at the transmitting end is lower than a specified value, the speech quality of a compensatory speech signal generated from the adjacent frame at the receiving end on the occurrence of loss of the packet corresponding to that frame will be low. Therefore, in order to minimize the occurrence of packet loss, a packet containing the speech signal of the same frame is transmitted the number of times equal to the value of a duplication level Ld, which is determined according to an objective evaluation value of an expected compensatory speech signal. In the example described above, the compensatory speech signal is generated by repeatedly copying a speech waveform of a pitch length from at least one adjacent frame to the current frame until the frame length is filled.

In the following embodiment, if it is determined that a compensatory speech signal of a better speech quality can be synthesized by using the pitch (and power) of the current frame, then the coded speech signal of the current frame is transmitted in a packet and the pitch parameter (and power parameter) of the same current frame is also sent in another packet for the same frame as side information, instead of duplications of the coded speech signal. If the packet containing the coded speech signal of the frame cannot be received and the packet of the side information is received at the receiving end, the side information can be used to generate a compensatory speech signal of a higher quality while reducing the volume of data to be transmitted.

Figure 23:
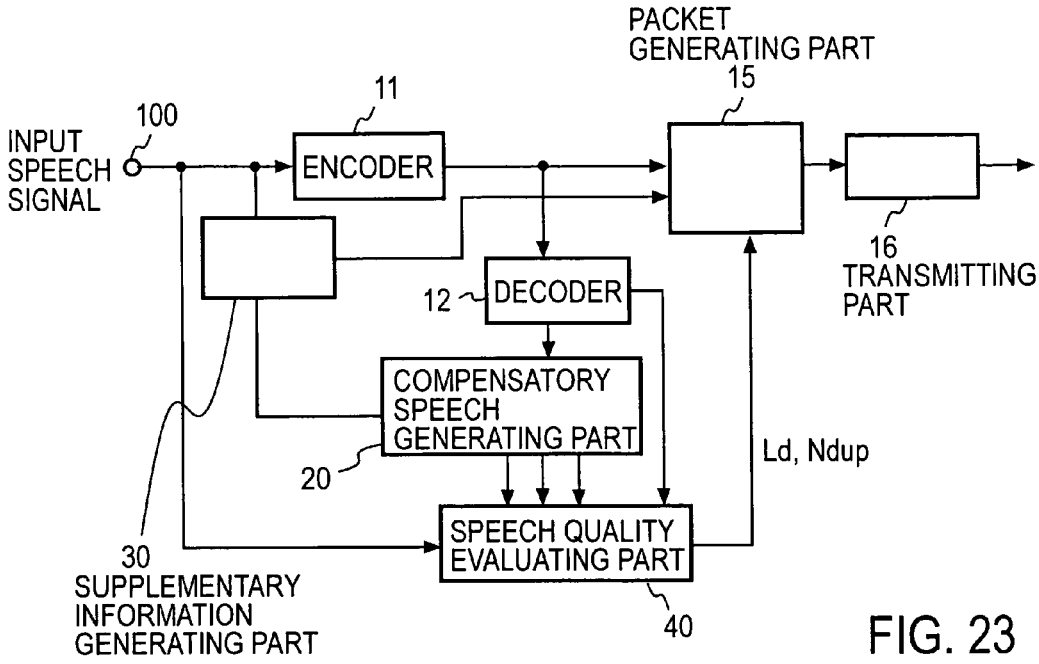
FIG. 23 is a block diagram showing a functional configuration of a speech packet transmitting apparatus according to a fourth embodiment of the present invention.

FIG. 23 shows an exemplary configuration of a transmitting apparatus that allows the use of such side information. In this configuration, a side information generating part 30 which obtains the pitch parameter (and power parameter) of the speech signal of the current frame is added to the transmitting apparatus shown in FIG. 1. A compensatory speech generating part 20 has: (1) a first function of detecting the pitch from at least one adjacent frame, cutting out a waveform of the pitch length, and generating a first compensatory speech signal based on the waveform, as described with respect to FIG. 1, (2) a second function of, instead of using the pitch detected from the waveform of the adjacent frame in the first function, using the pitch parameter of the speech signal of the current frame detected by the side information generating part 30 and cutting out a waveform of the pitch length from the waveform of the adjacent frame by using the pitch parameter to generate a second compensatory speech waveform, and (3) a third function of adjusting the power of the second compensatory speech signal synthesized on the basis of the power parameter of the speech signal of the current frame obtained by the side information generating part 30 in the second function to generate a third compensatory speech waveform that agrees with the speech signal power of the current frame.

A speech quality evaluating part 40 determines evaluation values Fd1, Fd2, and Fd3 based on the first, second, and third compensatory speech waveforms, respectively, and then determines a duplication level Ld and speech quality degradation level QL_1 which correspond to the evaluation value Fd1, a speech quality degradation level QL_2 corresponding to the evaluation value Fd2, and a speech quality degradation level QL_3 corresponding to the evaluation value Fd3, with reference to a table in which these values are predefined.

A packet generating part 15 determines, based on the value of duplication level Ld and by comparison among the speech quality degradation levels QL_1, QL_2, and QL_3, whether to put the speech data of the current frame into Ld number of packets to send out or to put the speech data of the current frame in one packet and identical side information (the pitch parameter, or the pitch and power parameters) into the remaining Ld−1 packets to send out. The packet generating part 15 generates and sends packets according to the determination. This process will be described later with reference to a flowchart.

Figure 24:
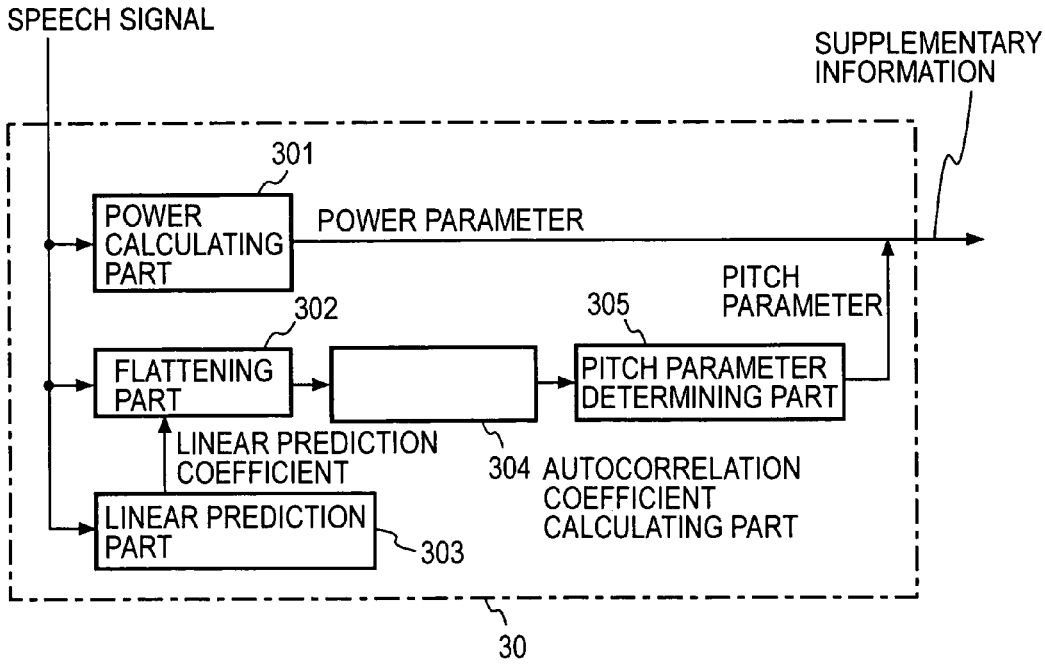
FIG. 24 is a block diagram showing a specific exemplary configuration of a side information generating part 30 shown in FIG. 23.

FIG. 24 shows an exemplary configuration of the side information generating part 30. The speech signal of the current frame is provided to a power calculating part 301, where the power $P=\Sigma x_n^2$ of the speech signal of the frame is calculated to obtain the power value as the power parameter. The speech signal is also provided to a linear prediction part 303, where linear prediction coefficients for the speech signal of the frame are obtained. The obtained linear prediction coefficients are provided to a flattening part 302 to form an inverse filter having the inverse characteristic of a spectral envelope based on linear prediction analysis. With this inverse filter, the speech signal is inverse-filtered and the its spectral envelope is flattened. The inverse-filtered speech signal is provided to an autocorrelation coefficient calculating part 304, where its autocorrelation coefficient is calculated as $$R(k) = \sum_{n=0}^{N-1} x_n x_{n-k} \qquad \text{[Equation 1]}$$

Here, it is preferable that $40 \leqq k \leqq 120$ if the input speech signal is sampled at 8 kHz. A pitch parameter determining part 305 detects, as the pitch, k that provides the peak of the autocorrelation coefficient R(k) and outputs the pitch parameter.

Figure 25:
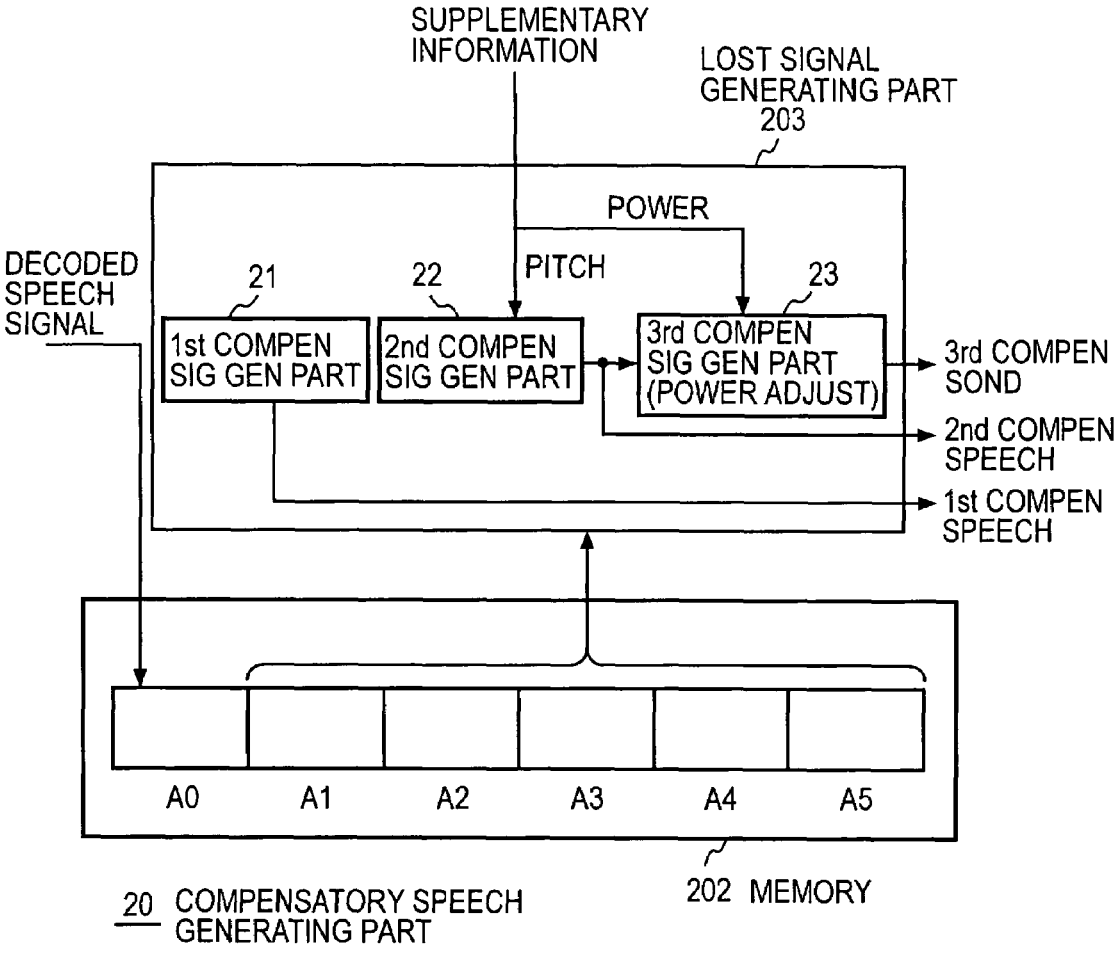
FIG. 25 is a block diagram showing a specific exemplary configuration of a compensatory speech generating part 20 shown in FIG. 23.

FIG. 25 shows an exemplary functional configuration of the compensatory speech generating part 20. As in the example in FIG. 2, the decoded speech signal of the current frame is written in area A0 in a memory 202 and the speech signal of the past frames held in areas A0-A4 is shifted to areas A1-A5. A lost signal generating part 203 has first, second, and third compensatory signal generating parts 21, 22, and 23. The first compensatory signal generating part 21 synthesizes a first compensatory speech signal by the first function stated above by repeatedly connecting a waveform cut out by using a pitch length detected from the waveform in areas A1-A5, as in the example in FIG. 2. The second compensatory signal generating part 22 synthesizes a second compensatory speech signal by the second function stated above by using the pitch parameter of the current frame, which is side information provided from the side information generating part 30, to cut out a waveform of the pitch length from the speech signal waveform in area A1 and repeatedly connecting the waveform. The third compensatory signal generating part 23 generates a third compensatory speech signal by the third function by adjusting the power of the second compensatory speech signal generated by the second compensatory signal generating part 22 by using the power parameter of the current frame provided by the side information generating part 30 as side information, so that the power of the second compensatory speech signal becomes equal to the current frame. Specifically, letting Pp denote the power parameter and $Pc=\Sigma y_n^2$ be the power of a compensatory speech signal before power adjustment, then a power-adjusted compensatory speech signal can be obtained by computing $K=(Pp/Pc)^{1/2}$ and multiplying each sample $y_n$ of the compensatory speech signal by K.

Figures 26, 27, 28:
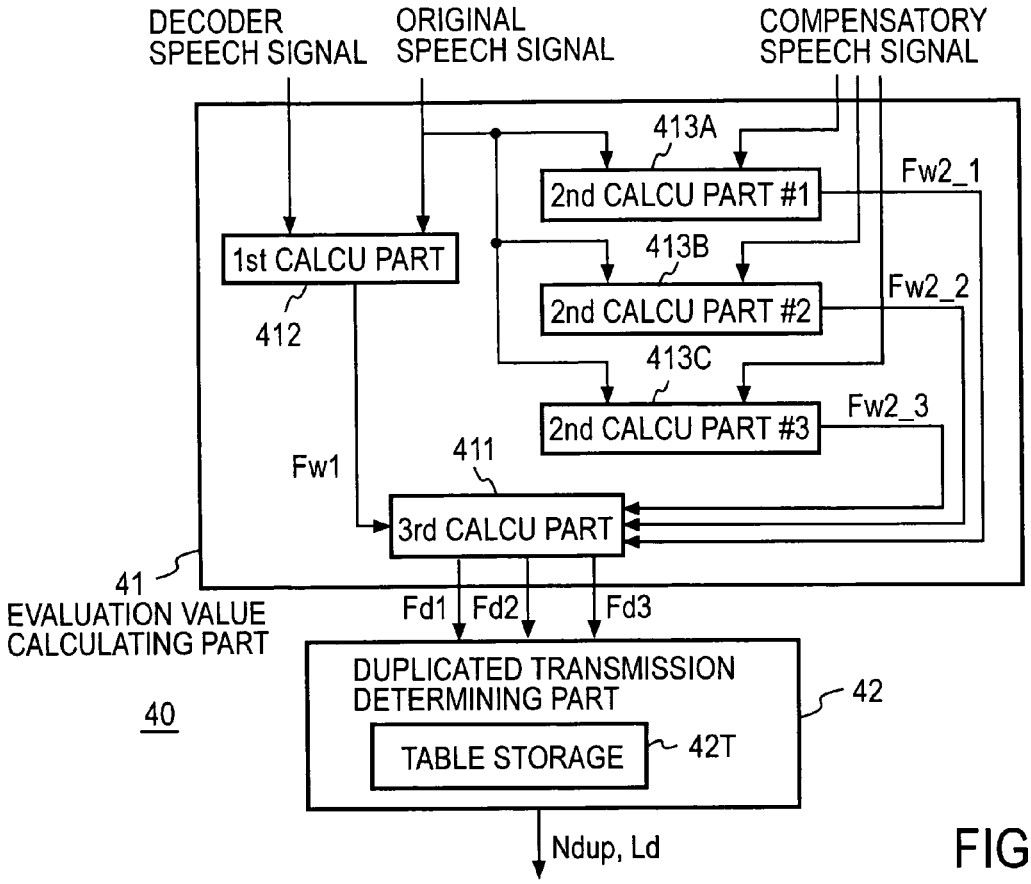
FIG. 26 is a block diagrams showing a specific exemplary configuration of a speech quality evaluating part 40 shown in FIG. 23.
FIG. 27 shows an exemplary table defining the relation between evaluation values, duplication levels, and speech quality degradation levels.
FIG. 28 shows an example of a table defining the relation between evaluation values and speech quality degradation levels.

FIG. 26 shows an exemplary configuration of a speech quality evaluating part 40. Like the speech quality evaluating part 40 in the example shown in FIG. 6, this speech quality evaluating part 40 includes an evaluation value calculating part 41 and a duplicated transmission determining part 42. The evaluation value calculating part 41 has a first calculating part 412, which calculates Fw1=WSNR(Org, Dec) from an original speech signal Org and a decoded speech signal Dec, a second calculating part #1 413A, which calculates Fw2_1=WSNR(Org, Com1) from the original speech signal Org and a first compensatory speech signal Com1, a second calculating part #2 413B, which calculates Fw2_2=WSNR (Org, Com2) from the original speech signal Org and a second compensatory speech signal Com2, and a second calculating part #3 413C, which calculates Fw2_3=WSNR(Org, Com3) from the original speech signal Org and a third compensatory speech signal Com3, and a third calculating part 411, which calculates a first evaluation value Fd1=Fw1−Fw2_1, a second evaluation value Fd2=Fw1−Fw2_2, and a third evaluation value Fd3=Fw1−Fw2_3. These evaluation values Fd1, Fd2, and Fd3 are provided to a duplicated transmission determining part 42.

Stored in a table storage 42T in the duplicated transmission determining part 42 are a table shown in FIG. 27 which defines a duplication level Ld and a speech quality degradation level QL_1 for the first evaluation value Fd1, a table shown in FIG. 28 which defines a speech quality degradation level QL_2 for the second evaluation value Fd2, and a table, not shown, similar to the one shown in FIG. 28, which defines a speech quality degradation level QL_3 for the third evaluation value. In the tables in FIGS. 27 and 28, the speech quality degradation level increases incrementally with increasing evaluation value. While the value of the duplication level Ld for the evaluation value Fd1 is the same as the value of the speech quality degradation level Q1_1 in the exemplary table in FIG. 27, the values do not need to be the same. These values are determined beforehand by experiment.

First Example of Operation

Figure 29:
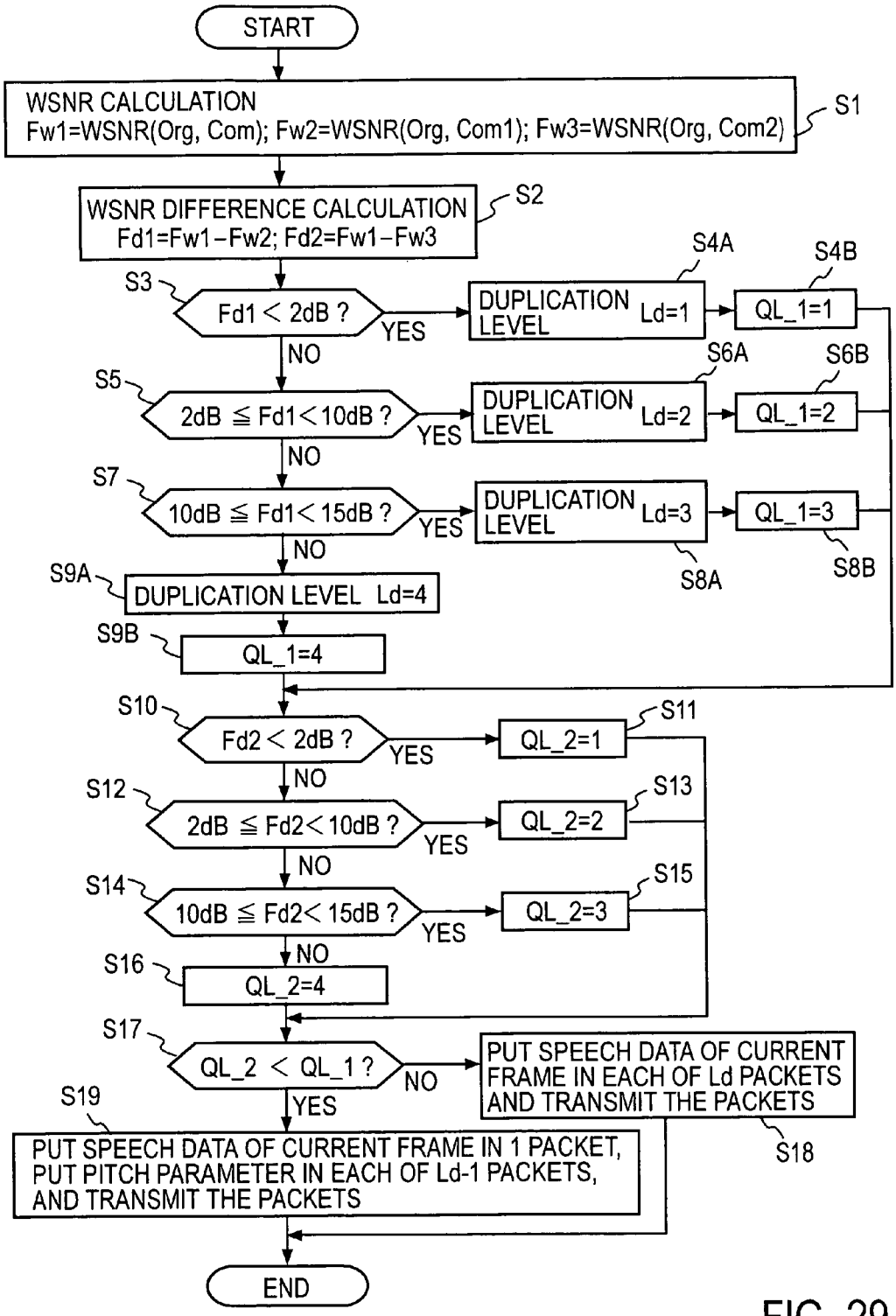
FIG. 29 is a flowchart of a process performed by the speech quality evaluating part 40 and the packet generating part 15 in a first example of operation of the transmitting apparatus shown in FIG. 23.

FIG. 29 shows a first example of operation of the transmitting apparatus in FIG. 23. In this example, a selection is made, according to the speech quality degradation level, whether to generate a compensatory speech signal Ext1 using a waveform and pitch length of a past frame as shown in FIG. 1 or a compensatory speech signal Ext2 using the pitch of the current frame and a waveform of a past frame. Provided to the compensatory speech generating part 20 are a pitch parameter and a power parameter obtained for the input speech signal of the current frame by the side information generating part 30 and decoded speech signal which has been generated by the decoder 12 decoding the speech signal of the current frame encoded by the encoder 11.

Step S1: The compensatory speech generating part 20 calculates Fw1=WSNR(Org, Dec) from an original speech signal (Org) and its decoded speech signal (Dec), calculates Fw2=WSNR(Org, Com1) from the original speech signal (Org) and a first compensatory speech signal (Com1), and calculates Fw3=WSNR(Org, Com2) from the original speech signal (Org) and a second compensatory speech signal (Com2).

Step S2: Difference evaluation values Fd1=Fw1−Fw2 and Fd2=Fw1−Fw3 are calculated.

At steps S3 to S9B, determination is made as to which range in the table in FIG. 27 the difference evaluation value Fd1 belongs to, and the values of the duplication level Ld and the speech quality degradation level QL_1 corresponding to that range are determined.

At steps S10 to S16, determination is made as to which range in the table in FIG. 28 the difference evaluation value Fd2 belongs to, and the value of the speech quality degradation level QL_2 corresponding to the range is determined.

Step S17: Determination is made as to whether or not the speech quality degradation level QL_1 is lower than QL_2, that is, whether or not the speech quality degradation level of the compensatory speech signal Com2 generated by using the pitch of the current frame is lower than that of the compensatory speech signal Com1 generated by the pitch of the past frame(s). If the speech quality degradation level of Com2 is not lower than that of Com1, that is, the speech quality will not be improved by using the pitch of the current frame, then the coded speech data of the current fame is put in all of Ld number of packets and the packets are sequentially transmitted at step S18.

Step S19: If the speech quality degradation level QL_2 is lower than QL_1, then the speech quality will be more improved by using the compensatory speech signal Ext2 generated by using the pitch-length of waveform cut out from the speech waveform in the past frame(s) using the pitch of the speech signal of the current frame than using the compensatory speech signal Ex1 generated by using only the speech signal of the past frame(s). Therefore, coded speech data of the current frame is put in one packet and the pitch parameter of the current frame is put in all of Ld-1 packets as side information and the packets are transmitted.

In this way, if a packet containing the speech data of the current frame can be received at the receiving end, the speech signal of the current frame can be regenerated, and if a packet containing the speech data of the current frame cannot be received at the receiving end but a packet containing the side information (the pitch parameter) of the current frame can be received, then the pitch of the current frame can be used to generate a compensatory speech signal from a speech waveform in the past frames, thereby degradation of the speech quality can be reduced to a certain extent.

Second Example of Operation

Figure 30:
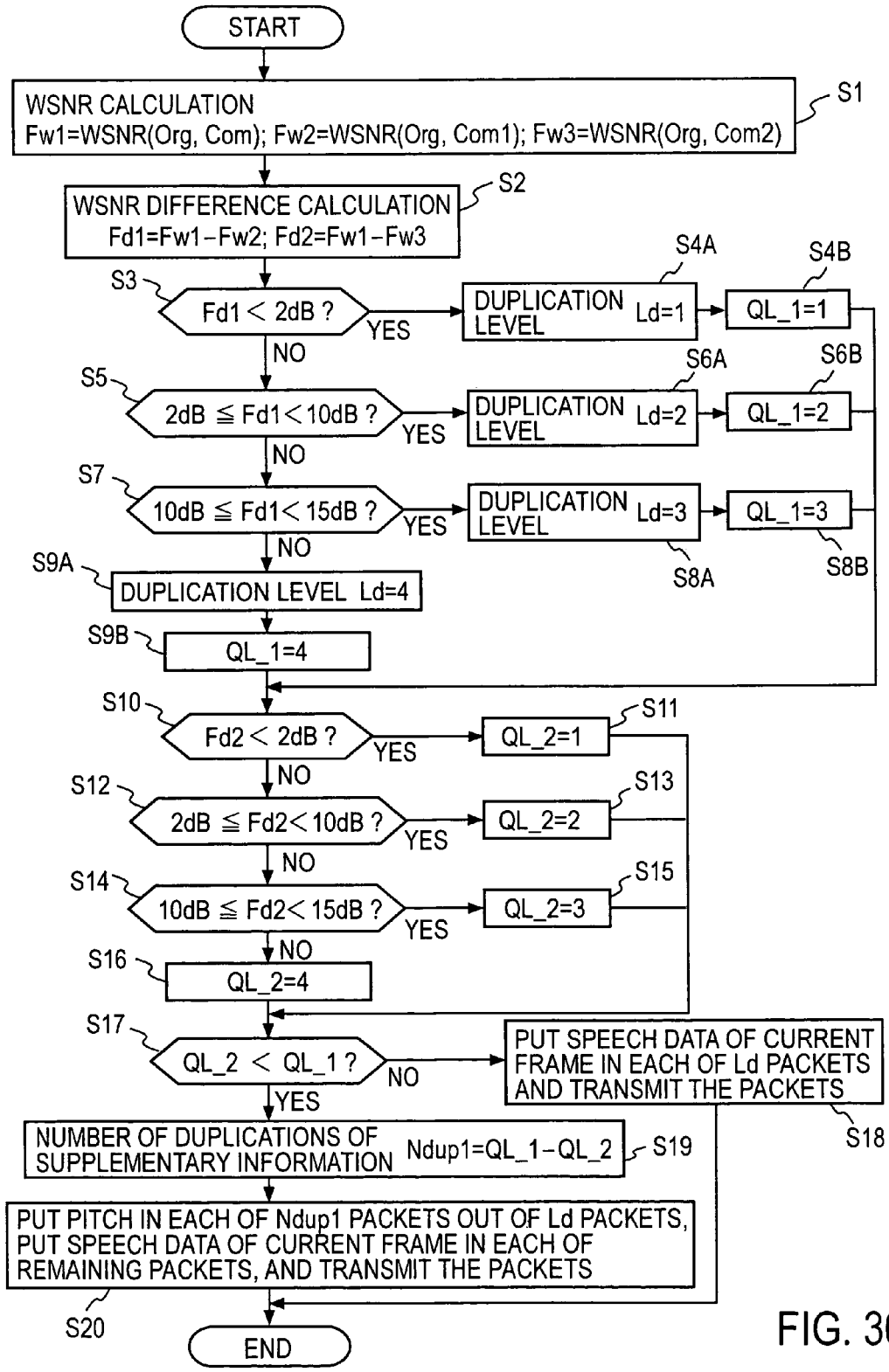
FIG. 30 is a flowchart of a process performed by the speech quality evaluating part 40 and the packet generating part 15 in a second example of operation of the transmitting apparatus shown in FIG. 23.

FIG. 30 shows a second example of operation. Steps S1 to S18 in this example of operation are the same as those steps S1 to S18 shown in FIG. 29, but the subsequent steps are different. That is, at step S19, the number of duplications of side information (the pitch parameter) is determined as the difference in quality level Ndup1=QL_1−QL_2 and the side information (here, the pitch parameter) of the current frame is put in each of Ndup1 number of packets of the Ld number of packets at step S20 and the coded speech data of the current frame is put in each of the remaining Ld−ndup1 packets, and then the packets are transmitted. That is, in the exemplary operation, if the speech quality degradation in the case of generating a compensatory speech signal by using the pitch of the current frame is smaller than in the case of generating a compensatory speech signal from only speech data of the past frame(s), the number of duplicated packets transmitting the same side information is changed according to the effect in reducing speech quality degradation, thereby the number of duplicated packets transmitting the coded speech data of the same current frame can also be changed reciprocally.

Third Example of Operation

Figure 31:
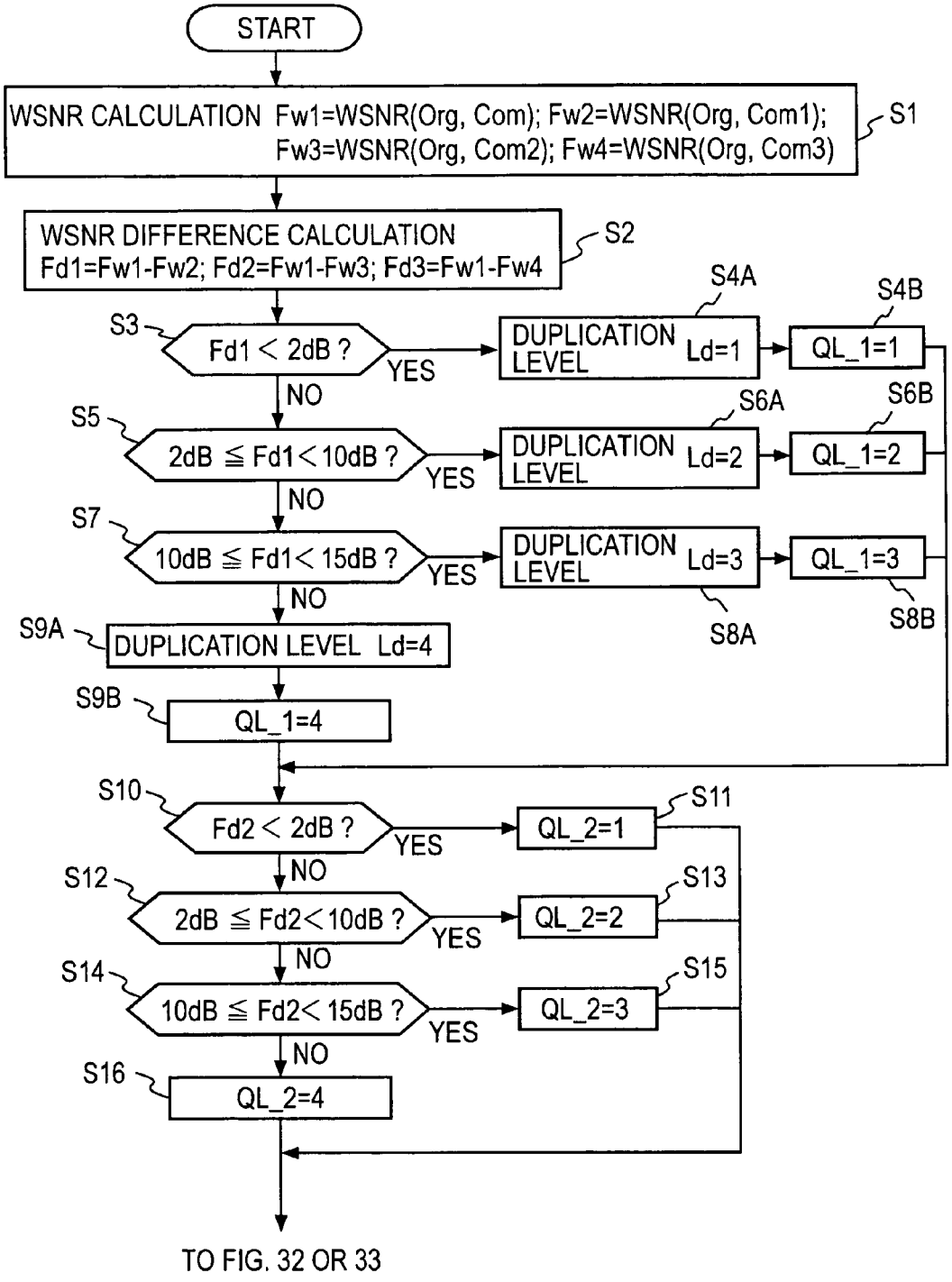
FIG. 31 is a flowchart showing the first half of a process performed by the speech quality evaluating part 40 and the packet generating part 15 in a third example of operation of the transmitting apparatus shown in FIG. 23.
Figure 32:
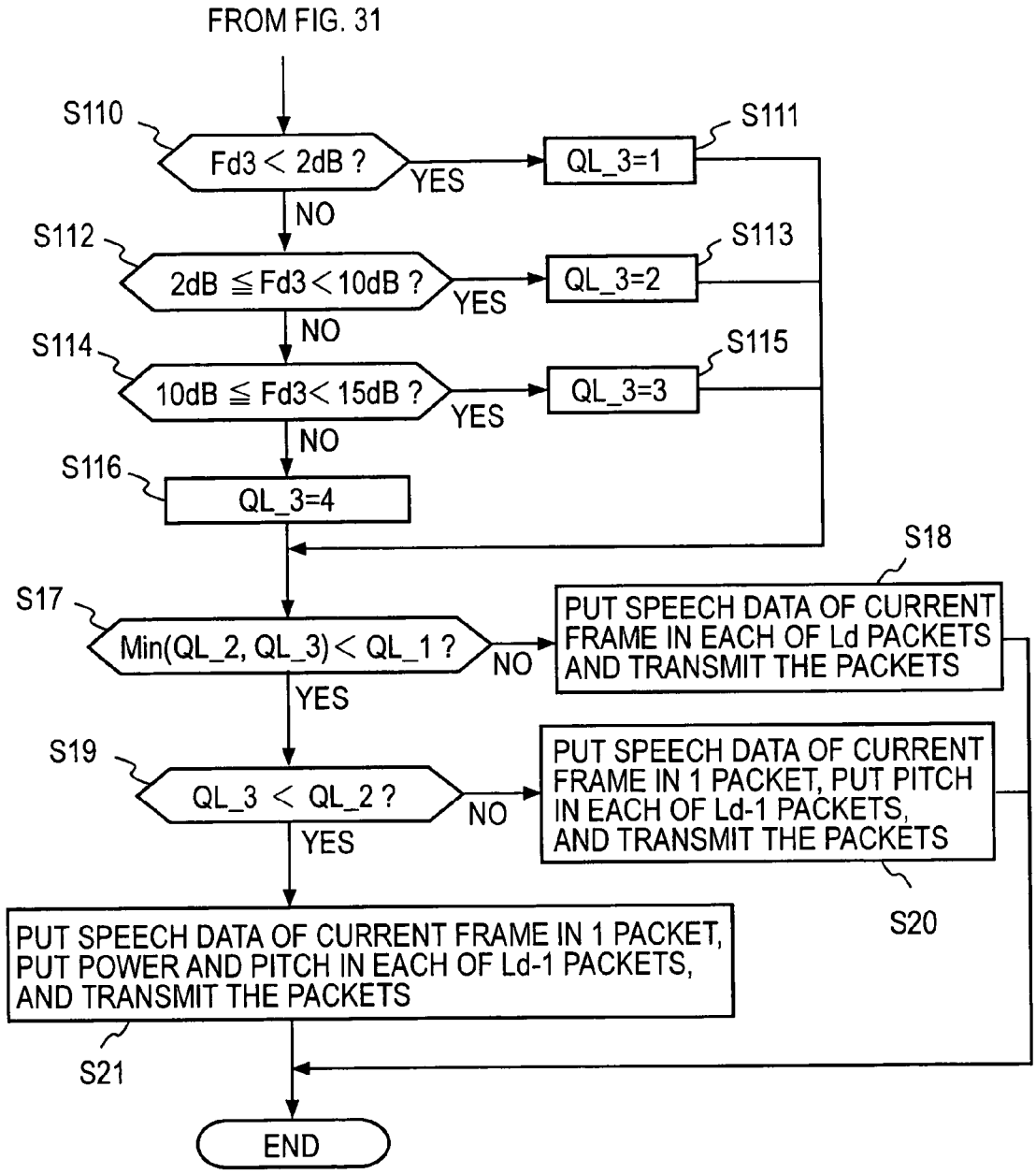
FIG. 32 is a flowchart showing the last half of the process in FIG. 31.

FIGS. 31 and 32 show a third example of operation. In this example of operation, the pitch and power parameters of the current frame are used as side information, in addition to the first and second compensatory speech signals Com1 and Com2 used in the first and second exemplary operations, and a third compensatory speech signal Com3 is generated from a waveform in the past frame(s). Accordingly, calculation of a fourth evaluation value Fw4=WSNR(Org, Com3) is performed at step S1 in addition to the WSNR calculations at step S1 in FIG. 30 and, at step S2, calculation of Fd3=Fw1−Fw4 is performed in addition to the WSNR difference calculations at step S2 in FIG. 30. Furthermore, steps S110 to S116 are added for determining a speech quality degradation level QL_3 for Fd3 in a manner similar to the determination of the speech quality degradation level QL_2 for Fd2 in steps S10 to S16 in FIG. 30.

At step S17, determination is made as to whether either QL_2 or QL_3, whichever smaller, is smaller than QL_1 or not. If not, the coded speech data of the current frame is put in each of the Ld number of packets and transmitted at step S18. If either of them is smaller than QL_1, then determination is made at step S19 as to whether QL_3 is smaller than QL_2 or not. If not, then one packet containing the coded speech data of the current frame and Ld−1 number of packets containing the pitch parameter of the current frame are generated and transmitted at step S20, in a manner similar to step S19 of FIG. 29. If QL_3 is smaller than QL_2, then one packet containing the coded speech data of the current frame and Ld−1 packets containing the pitch and power of the current frame are generated and transmitted at step S21.

Fourth Example of Operation

Figure 33:
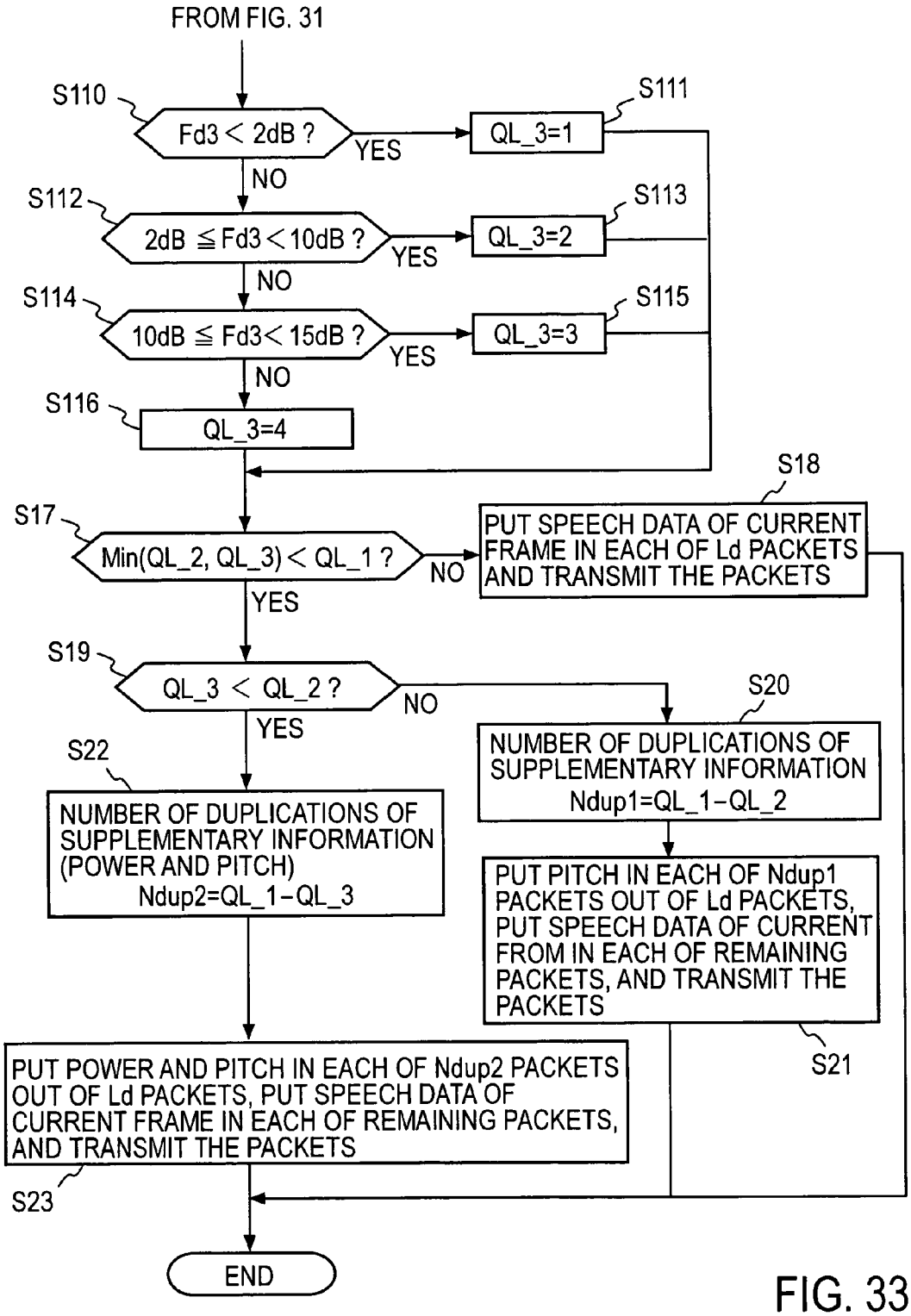
FIG. 33 is a flowchart showing the last half of a process performed by the speech quality evaluating part 40 and the packet generating part 15 in a fourth example of operation of the transmitting apparatus shown in FIG. 23.

A fourth exemplary operation is a variation of the third exemplary operation. The steps in the first half of the process are the same as those steps S1 to S16 of the third exemplary operation shown in FIG. 31, which therefore is used in also this example. The steps subsequent to step S16 are shown as steps S110 to S23 in FIG. 33. Out of these steps, steps S110 to S116 for determining a speech quality degradation level QL_3 for Fd3 are the same as those steps S110 to S116 in the third exemplary operation shown in FIG. 32. Also, steps S17 and S18 are the same as those in FIG. 32.

If QL_3 is not smaller than QL_2 at step S19, it means that using the pitch and power parameters of the current frame as side information cannot provide an improvement in the speech quality of the compensatory speech signal over using only the pitch parameter of the current frame. Therefore, the number of duplications of the pitch parameter is determined as Ndup1=QL_1−QL_2 at step S20, the pitch parameter of the current frame is put in Ndup1 number of packets at step S21, the coded speech data of the current frame is put in the remaining Ld−Ndup1 number of packets, and these packets are transmitted. If QL_3 is smaller than QL_2 at step S19, it means that using both pitch and power parameters of the current frame provides an improvement in the speech quality of the compensatory speech signal over using only the pitch parameter of the current frame as the side information. Therefore, the duplication value of the side information (pitch and power) is determined as Ndup2=QL_1−QL_3 at step S22, the side information of the current frame is put in Ndup2 number of packets, the coded speech data of the current frame is put in all of the remaining Ld−Ndup2 number of packets, and the packets are transmitted at step S23.

Figure 34:
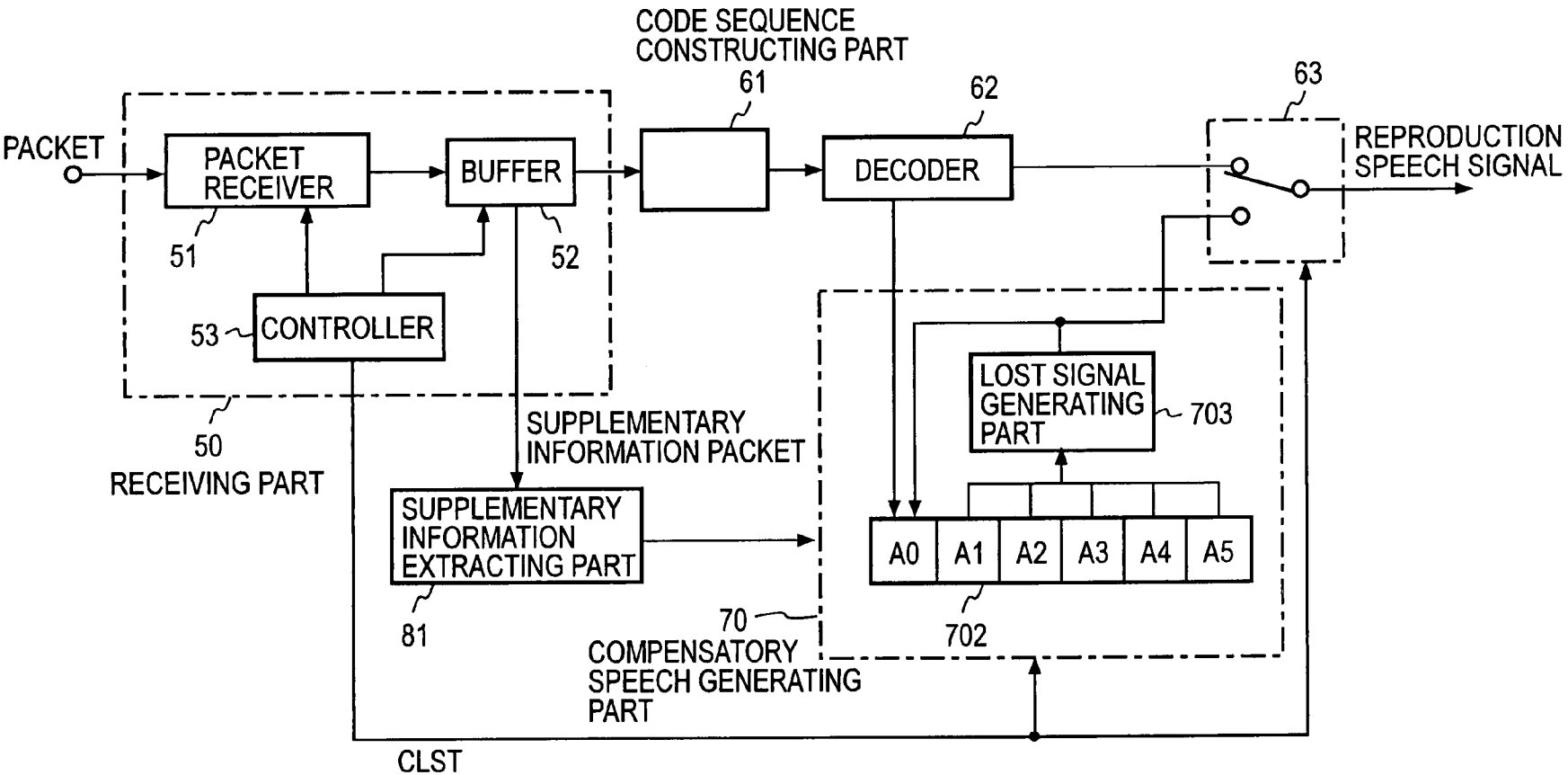
FIG. 34 is a block diagram showing an example of a receiving apparatus associated with the transmitting apparatus shown in FIG. 23.
Figure 35:
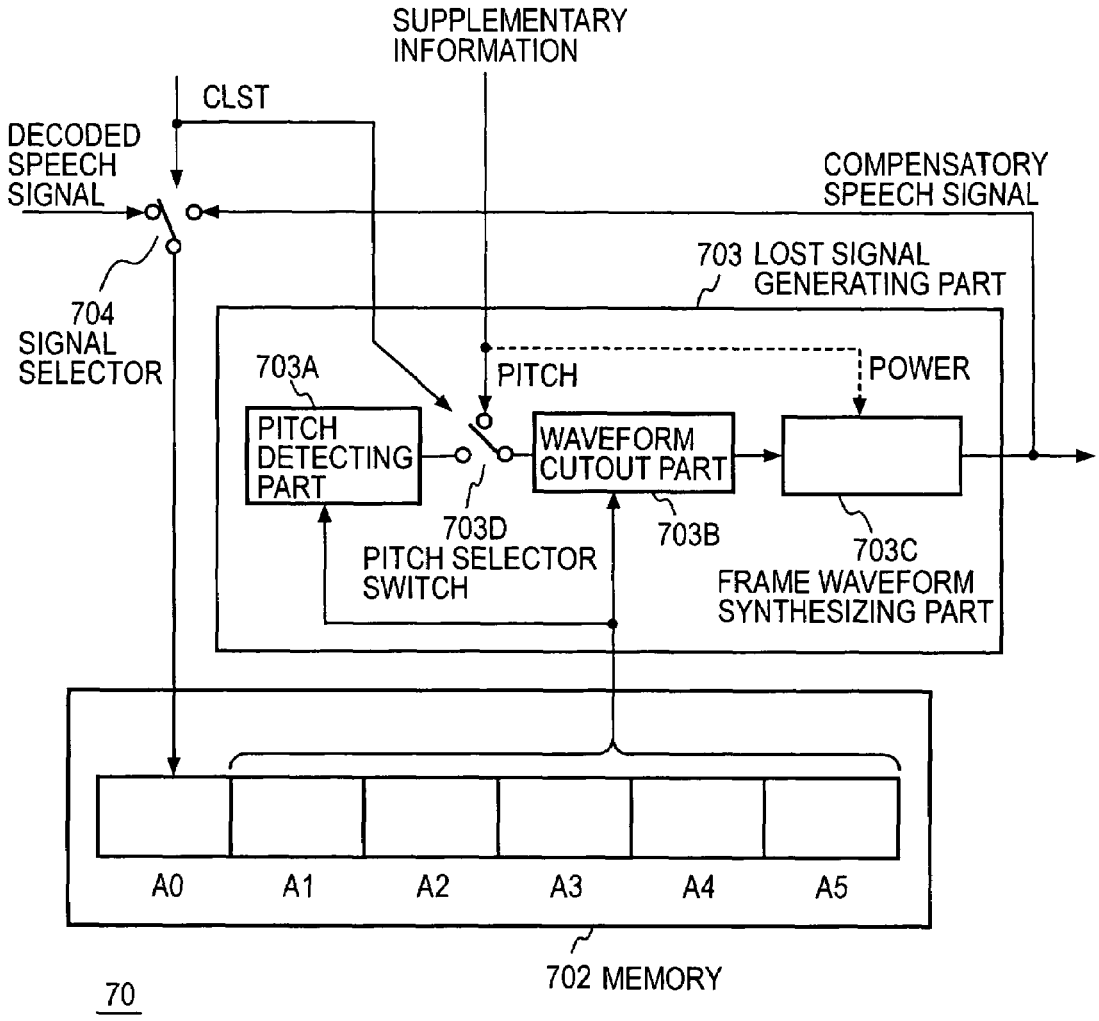
FIG. 35 is a block diagram showing a specific exemplary configuration of a compensatory speech generating part 70 shown in FIG. 34.

FIG. 34 shows an exemplary configuration of a receiving apparatus associated with the transmitting apparatus in FIG. 23. In this configuration, a side information extracting part 81 is added to the receiving apparatus shown in FIG. 13. Furthermore, a compensatory speech generating part 70 includes a memory 702, a lost signal generating part 703, and a signal selector 704, as shown in FIG. 35. The lost signal generating part 703 includes a pitch detecting part 703A, a waveform cutout part 703B, a frame waveform synthesizing part 703C, and a pitch selector switch 703D.

A controller 53 checks a buffer 52 to see whether a packet for the same frame contained in a received packet is already stored in the buffer 52. If not, the controller 53 stores the received packet in the buffer 52. This process will be detailed later with reference to a flowchart in FIG. 36A.

In a process for reproducing a speech signal, the controller 53 checks the buffer 52 to see whether a packet of a frame currently required is stored in the buffer 52, as will be described later with reference to a flowchart in FIG. 36B. If it is not stored, the controller 53 determines that the packet has been lost and generates a control signal CLST. When the controller 53 generates the control signal CLST, the signal selector 704 selects the output of the lost signal generating part 703 and the pitch selector switch 703D selects a pitch detected by the pitch detecting part 703A and provides it to the waveform cutout part 703B, which then cuts out a waveform of the pitch length from area A1 of the memory 702. The frame waveform synthesizing part 703C synthesizes a waveform of one frame length from the cut out waveform and provides the synthesized waveform to the output selector 63 as a compensatory speech signal and also writes it into area A0 in the memory 702 through the signal selector 704.

If the controller 53 finds a packet containing the coded speech data of the current frame in the buffer 52, the controller 53 provides the packet to a code sequence constructing part 61, where the coded speech data is extracted from the packet. The coded speech data is decoded in the decoder 62, and the decoded speech signal is outputted through the output signal selector 63 and also written in area A0 in the memory 702 of the compensatory speech generating part 70 through the signal selector 704. If the controller 53 finds a packet containing side information on the current frame, the controller 53 provides the packet to the side information extracting part 81.

The side information extracting part 81 extracts the side information (the pitch parameter or the combination of the pitch parameter and power parameter) on the current frame from the packet and provides it to the lost signal generating part 703 in the compensatory speech generating part 70. When the side information is provided, the pitch parameter of the current frame in the side information is provided to the waveform cutout part 703B through the pitch selector switch 703D. Thus, the waveform cutout part 703B cuts out a waveform of the provided pitch length of the current frame from the speech waveform in area A1. Based on this waveform, the frame waveform synthesizing part 703C synthesizes and outputs one frame of waveform as a compensatory speech signal. If the side information also contains the power parameter of the current frame, the frame waveform synthesizing part 703C uses the power parameter to adjust the power of the synthesized frame waveform and outputs the waveform as a compensatory speech signal. In either case, when the compensatory speech signal is generated, it is written in area A0 of the memory 702 through the signal selector 704.

Figure 36A:
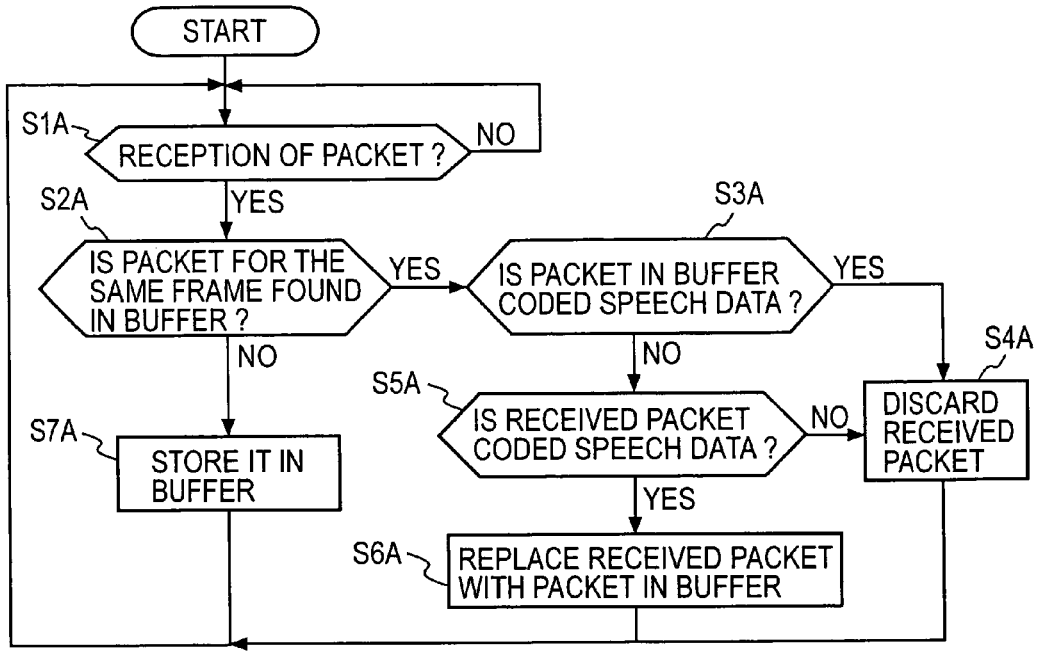
FIG. 36A is a flowchart of a process for processing a received packet in FIG. 34.

FIG. 36A shows an example of a process for storing a packet received at a packet receiver 51 in the buffer 52 under the control of the controller 53.

Determination is made at step S1A as to whether a packet has been received. If received, the buffer 52 is checked at step S2A to see whether a packet containing data with the same frame number as that of the data contained in the received packet is already in the buffer 52. If so, the data contained in the packet in the buffer is checked at step S3A to determine whether it is coded speech data. If it is coded speech data, the received packet is unnecessary and therefore discarded at step S4A, then the process returns to step S1A, where the process waits for the next packet.

If the data in the packet of the same frame in the buffer is not coded speech data at step S3A, that is, if the data is side information, then determination is made at step S5A as to whether the data in the received packet is coded speech data. If it is not coded speech data (that is, if it is side information), the received packet is discarded at step S4A and then the process returns to step S1A. If at step S5A the data in the received packet is coded speech data, the packet of the same frame contained in the buffer is replaced with the received packet at step S6A and then the process returns to step S1A. That is, if the received packet of the same frame is coded speech data, then compensatory speech does not need to be generated and therefore the side information is not required. If the buffer does not contain a packet of the same frame, the received packet is stored in the buffer 52 at step S7A and then the process returns to step S1A to wait for the next packet.

Figure 36B:
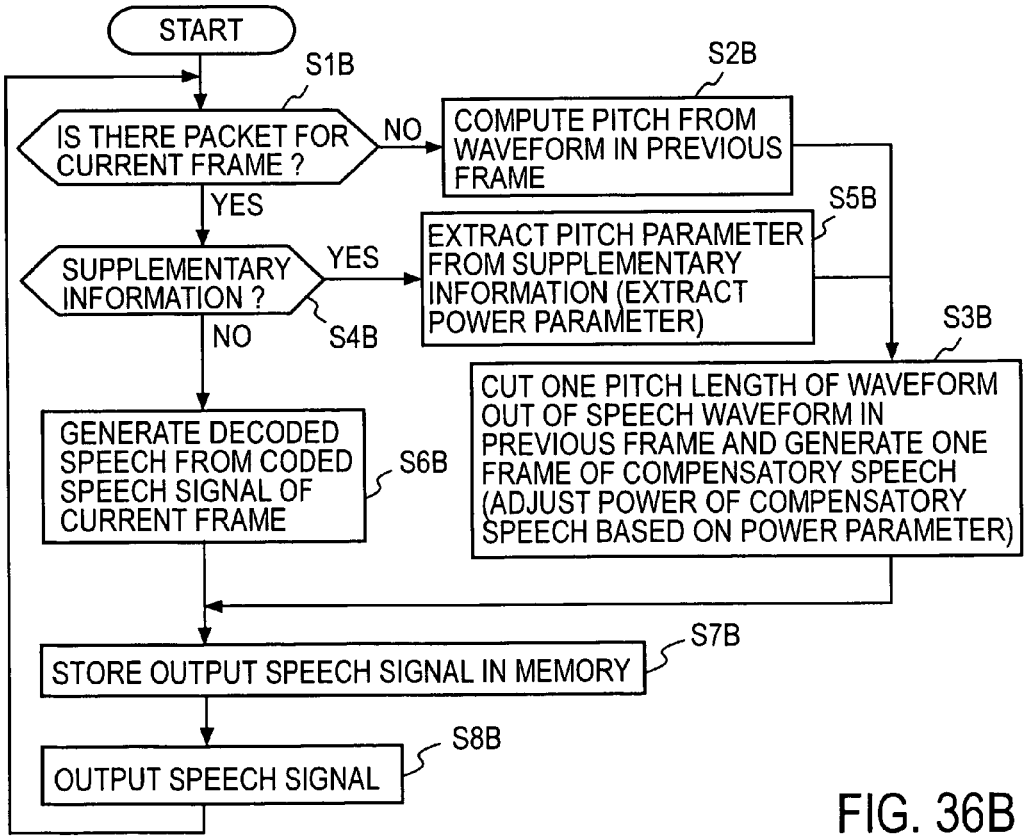
FIG. 36B is a flowchart of a process for generating reproduction speech in FIG. 34.

FIG. 36B shows an example of a process for extracting speech data from a packet read out from the buffer 52 and outputting a reproduction speech signal under the control of the controller 53.

At step S1B, the buffer 52 is checked to see if there is a packet for the current frame required. If not, it is determined that packet loss has occurred and a pitch is detected from the past frame by the pitch detecting part 703A of the lost signal generating part 703. The detected pitch length is used to cut out one pitch length of waveform from the speech waveform in the past frame and one frame length of waveform is synthesized at step S3B, the synthesized waveform is stored in area A0 in the memory 702 as a compensatory speech signal at step S7B, the compensatory speech signal is outputted at step S8B, and then the process returns to step S1B, where the process for the next frame is started.

If at step S1B the buffer 52 contains a packet for the current frame, determination is made at step S4B as to whether the data in the packet is side information. If it is side information, the pitch parameter is extracted from the side information at step S5B and the pitch parameter is used to generate a compensatory speech signal at step S3B. If it is determined at step S4B that the data in the packet for the current frame is not side information, the data in the packet is coded speech data. Therefore, the coded speech data is decoded to obtain speech waveform data at step S6B, and the speech waveform data is written in area A0 in the memory 402A at step S7B, and the speech waveform is outputted as a speech signal at step S8B, then the process returns to step S1B.

The process in FIG. 36B corresponds to the exemplary operation in FIG. 30 in the transmitting end. In the case of a process corresponding to the exemplary operation in FIGS. 31, 32, and 33, then the power parameter is also extracted from the side information at step S5B as shown in the parentheses, and the power of the synthesized waveform is adjusted according to the power parameter at step S3B as shown in the parentheses.

What is claimed is:

1. A speech packet transmitting method for transmitting an input speech signal on a frame-by-frame basis by using packets, comprising the steps of:

(a-1) generating a code sequence by encoding the input speech signal and generating a decoded speech signal by decoding the code sequence;

(a-2) generating a compensatory speech signal for a speech signal of a current frame from a speech signal of at least one frame adjacent to the current frame;

(b) calculating a first speech quality evaluation value from the input speech signal and the decoded speech signal and calculating a second speech quality evaluation value from the input speech signal and the compensatory speech signal;

(c) determining a duplication level based on the first and second speech quality evaluation values, the duplication level being an integer value of 1 or more which increases incrementally as speech Quality of the compensatory speech signal decreases;

(d) generating packets for the speech signal of the current frame as many packets as the number specified by the duplication level; and (e) transmitting the generated packet to a network.

2. A speech packet transmitting method for transmitting an input speech signal on a frame-by-frame basis by using packets, comprising the steps of:

(a-1) generating side information including at least a pitch parameter which is a feature parameter of the speech signal of a current frame;

(a-2) generating: from the speech signal of at least one adjacent frame, a first compensatory speech signal having a pitch of the speech signal of at least one frame; and (a-3) generating a second compensatory speech signal from the speech signal of the at least one adjacent frame by using at least the pitch parameter in the side information for the current frame;

(b) calculating a first speech quality evaluation value for the first compensatory speech signal and obtaining a second speech quality evaluation value for the second compensatory speech signal;

(c) determining, on the basis of the first speech quality evaluation value, a duplication level of an integer equal to or greater than one and a first speech quality degradation level which increases incrementally as the speech quality degrades and determining, on the basis of the second speech quality evaluation value, a second speech quality degradation level which increases incrementally as the speech quality degrades;

(d) if the second speech quality degradation level is not smaller than the first speech quality degradation level, generating as many packets of the speech signal of the current frame as the number equal to the value of the duplication level, if the second speech quality degradation level is smaller than the first speech quality degradation level, generating one or more packets of the speech signal of the current frame and one or more packets of the side information, a total number of the generated packets of the speech signal and the side information for the current frame being equal to the value of the duplication level; and (e) transmitting as many packets in total as the number equal to the value of the duplication level for the current frame.

3. The speech packet transmitting method according to claim 2, wherein, the step (c) further comprises the step of calculating the difference between the first speech quality degradation level and the second speech quality degradation level as the number of duplications of side information; and the step (d) generates as many packets of the side information as the number of the duplications of side information if the second speech quality degradation level is smaller than the first speech quality degradation level.

4. A speech packet transmitting method for transmitting an input speech signal on a frame-by-frame basis by using packets, comprising the steps of:

(a-1) generating side information including a pitch parameter and a power parameter which are feature parameters of the speech signal of the current frame;

(a-2) generating from the speech signal of at least one adjacent frame a first compensatory speech signal having a pitch of the speech signal of the at least one frame;

(a-3) generating a second compensatory speech signal from the speech signal of the at least one adjacent frame by using the pitch parameter in side information; and (a-4) generating a third compensatory speech signal from the speech signal of the at least one adjacent frame by using the pitch parameter and the power parameter in the side information;

(b) calculating a first speech quality evaluation value for the first compensatory speech signal, calculating a second speech quality evaluation value for the second compensatory speech signal, and calculating a third speech quality evaluation value for the third compensatory speech signal;

(c-1) determining, on the basis of the first speech quality evaluation value a duplication level of an integer equal to or greater than one and a first speech quality degradation level which increase incrementally as the speech quality degrades;

(c-2) determining, on the basis of the second speech quality evaluation value, a second speech quality degradation level which increases incrementally as the speech quality degrades; and (c-3) determining, on the basis of the third speech quality evaluation value, a third speech quality degradation level which increases incrementally as the speech quality degrades;

(d) if either the second or third speech quality degradation level, whichever smaller, is not smaller than the first speech quality degradation level, generating as many packets of the speech signal of the current frame a number equal to the value of the duplication level;

if either the second or the third speech quality degradation level whichever is smaller is smaller than the first speech quality degradation level and the third speech quality degradation level is not smaller than the second speech quality degradation level, generating one or more packets of the speech signal of the current frame and one or more packets of the side information including the pitch parameter, a total number of the generated packets of the speech signal and the side information for the current frame being equal to the value of the duplication level, and if the third speech quality degradation level is smaller than the second speech quality degradation level, generating one or more packets of the speech signal of the current frame and one or more packets of side information including the pitch parameter and the power parameter, the total number of the generated packets of the speech signal and the side information for the current frame being equal to the value of the duplication level; and (e) transmitting for the current frame, as many packets in total as the number equal to the value of the duplication level.

5. The packet transmitting method according to claim 4, further comprising:

calculating the difference between the first speech quality degradation level and the second speech quality degradation level as a first number of duplications of side information and calculating the difference between the first speech quality degradation level and the third speech quality degradation level as a second number of duplications of side information; and the step (d) generates as many packets of the pitch parameter as the first number of duplications of side information if the third speech quality degradation level is not smaller than the second speech quality degradation level, and generates as many packets of side information including the pitch parameter and the power parameter as the second number of duplications of side information if the third speech quality degradation level is smaller than the second speech quality degradation level.

6. A computer-readable recording medium having recorded thereon a program which causes a computer to perform the speech packet transmitting method according to any one of claims 1, 2 or 4.

7. A speech packet transmitting apparatus which transmits an input speech signal on a frame-by-frame basis by using packets, comprising:

a side information generating part which is configured to generate a pitch parameter of the speech signal of a current frame as side information;

a compensatory speech signal generating part which is configured to generate, from the speech signal of the at least one frame, a first compensatory speech signal having a pitch of the speech signal of the at least one frame adjacent to the current frame and generates a second compensatory speech signal from the speech signal of the at least one frame adjacent to the current frame by using the pitch parameter in the side information of the current frame;

a speech quality evaluation value calculating part which is configured to calculate a first speech quality evaluation value for the first compensatory speech signal and a second speech quality evaluation value for the second compensatory speech signal;

a duplicated transmission determining part which is configured to determine, on the basis of the first speech quality evaluation value, a duplication level of an integer equal to or greater than one and a first speech quality degradation level that increase incrementally as the speech quality degrades and determines, on the basis of the second speech quality evaluation value, a second speech quality degradation level which increases incrementally as the speech quality degrades;

a packet generating part which is configured to generate as many packets of the speech signal of the current frame as a number equal to the value of the duplication level if the second speech quality degradation level is not smaller than the first speech quality degradation level, and generates one or more packets of the speech signal of the current frame and one or more packets of the side information, the total number of the generated packets of the speech signal and the side information for the current frame being the number equal to the value of the duplication level, if the second speech quality degradation level is smaller than the first speech quality degradation level; and a transmitting part which is configured to transmit the generated speech packets to a network.

8. A speech packet transmitting apparatus which transmits an input speech signal on a frame-by-frame basis by using packets, comprising:

a side information generating part which is configured to generate a pitch parameter and a power parameter of the speech signal of a current frame as side information;

a compensatory speech signal generating part which is configured to generate, for the current frame, a first compensatory speech signal from only the speech signal of at least one frame adjacent to the current frame, generates a second compensatory speech signal from the speech signal of the at least one frame adjacent to the current frame by using the pitch parameter in the side information of the current frame, and generates a third compensatory speech signal from the speech signal of the at least one frame adjacent to the current frame by using the pitch parameter and the power parameter in the side information of the current frame;

a speech quality evaluation value calculating part which is configured to calculate a first speech quality evaluation value for the first compensatory speech signal, a second speech quality evaluation value for the second compensatory speech signal, and a third speech quality evaluation value for the third compensatory speech signal;

a duplicated transmission determining part which is configured to determine, on the basis of the first speech quality evaluation value, a duplication level of an integer equal to or greater than one and a first speech quality degradation level which increase incrementally as the speech quality degrades, determine, on the basis of the second speech quality evaluation value, a second speech quality degradation level which increases incrementally as the speech quality degrades, and determine, on the basis of the third speech quality evaluation value, a third speech quality degradation level which increases as the speech quality degrades; and a packet generating part which is configured to generate, if the second or third speech quality degradation level are smaller than the first speech quality degradation level, as many packets of the speech signal of the current frame as the number equal to the value of the duplication level, generate, if either the second or third speech quality degradation level, whichever smaller, is smaller than the first speech quality degradation level and the third speech quality degradation level is not smaller than the second speech quality degradation level, one or more packets of the speech signal of the current frame and one or more packets of the pitch parameter, a total number of the generated packets of the speech signal and the side information being equal to the value of the duplication level, and generate, if the third speech quality degradation level is smaller than the second speech quality degradation level, one or more packets of the speech signal of the current frame and one or more packets of side information including the pitch parameter and the power parameter, the total number of the generated packets of the speech signal and the side information for the current frame being equal to the value of the duplication level; and a transmitting part which is configured to transmit the generated speech packets to a network.

9. A speech packet transmitting apparatus for transmitting an input speech signal on a frame-by-frame basis by using packets, comprising:

an encoding part which is configured to generate a code sequence by encoding the input speech signal;

a decoding part which is configured to generate a decoded speech signal by decoding the code sequence;

a compensatory speech signal generating part which is configured to generate a compensatory speech signal for a speech signal of a current frame from a speech signal of at least one frame adjacent to the current frame;

a speech quality evaluation value calculating part which is configured to calculate a first speech quality evaluation value from the input speech signal and the decoded speech signal and calculate a second speech quality evaluation value from the input speech signal and the compensatory speech signal;

a duplication level determining part which is configured to determine a duplication level based on the first and second speech quality evaluation values, the duplication level being an integer value of 1 or more which increases incrementally as speech quality of the compensatory speech signal decreases;

a packet generating part which is configured to generate packets for the speech signal of the current frame as many packets as a number specified by the duplication level; and a transmitting part which is configured to transmit the generated packet to a network.

* * * * *